US010495418B2

(12) United States Patent
Hinschberger et al.

(10) Patent No.: US 10,495,418 B2
(45) **Date of Patent: *Dec. 3, 2019**

(54) RELEASABLY ENGAGABLE SYSTEM OF BALLISTIC RESISTANT PANELS

(71) Applicant: Angel Armor, LLC, Fort Collins, CO (US)

(72) Inventors: Ross M. Hinschberger, Cheyenne, WY (US); Jason M. Thompson, Fort Collins, CO (US); Christopher R. Foth, Windsor, CO (US)

(73) Assignee: Angel Armor, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/407,155

(22) Filed: Jan. 16, 2017

(65) Prior Publication Data

US 2018/0112954 A1 Apr. 26, 2018

Related U.S. Application Data

(60) Provisional application No. 62/279,202, filed on Jan. 15, 2016, provisional application No. 62/278,811, filed on Jan. 14, 2016.

(51) Int. Cl.
*F41H 1/02* (2006.01)
*F41H 5/013* (2006.01)
(Continued)

(52) U.S. Cl.
CPC ..... *F41H 5/013* (2013.01); *A41D 1/04* (2013.01); *A41D 13/0153* (2013.01); *A41D 13/0568* (2013.01); *F41H 1/02* (2013.01)

(58) Field of Classification Search
CPC ... F41H 5/00; F41H 5/013; F41H 5/04; F41H 5/0414; F41H 5/0428; F41H 5/0492; F41H 1/00; F41H 1/02
(Continued)

(56) References Cited

U.S. PATENT DOCUMENTS 3,962,976 A * 6/1976 Kelsey ..... F41H 5/0457 109/82
4,167,889 A * 9/1979 Bohne ..... F41H 5/013 89/36.02
(Continued)

FOREIGN PATENT DOCUMENTS

WO 2011/141172 11/2011

OTHER PUBLICATIONS

Tencate Advanced Armor. TenCate Multi-light™ CXP-461 IC Torso. Website, https://www.tencateadvancedarmor.com/personal-protection/Body-armor-plates/TenCate-Multi-light-hard-body-armor-plates/4Tpr/TenCate-Multi-light-CXP-461-IC-Torso, originally downloaded Feb. 25, 2019, one page.
(Continued)

*Primary Examiner* — Jonathan C Weber
(74) *Attorney, Agent, or Firm* — Craig R. Miles; CR MILES P.C.

(57) ABSTRACT

Disclosed herein are embodiments of a releasably engagable system of ballistic-resistant panels including a first ballistic-resistant panel having opposing first ballistic-resistant panel front and back surfaces and a second ballistic-resistant panel having opposing second ballistic-resistant panel front and back surfaces. Additionally, the embodiments of the releasably engagable systems of ballistic-resistant panels include at least one of fasteners, an adhesive coating, or a securement element, all of which function to releasably engage the second ballistic-resistant panel front surface with the first ballistic-resistant panel back surface in fixed adjacent relation to provide releasably engaged ballistic-resistant panels. Further, disclosed herein are embodiments of a ballistic-resistant garment configured to receive an embodiment of the releasably engaged ballistic-resistant panels.

10 Claims, 25 Drawing Sheets

(51) Int. Cl.
*A41D 13/015* (2006.01)
*A41D 13/05* (2006.01)
*A41D 1/04* (2006.01)

(58) Field of Classification Search
USPC ..... 98/36.01–36.17; 109/49.5; 89/36.01–36.17
See application file for complete search history.

(56) References Cited

U.S. PATENT DOCUMENTS 4,928,575 A * 5/1990 Smirlock ..... F41H 5/013 52/612
5,170,690 A * 12/1992 Smirlock ..... F41H 5/013 89/36.02
5,191,166 A * 3/1993 Smirlock ..... F41H 5/013 109/49.5
5,333,532 A * 8/1994 Smirlock ..... F41H 5/013 109/49.5
5,792,974 A * 8/1998 Daqis ..... F41H 5/013 109/49.5
7,458,306 B2 * 12/2008 Singh ..... F41H 7/04 89/36.02
8,757,042 B2 * 6/2014 Pfister ..... F41H 7/04 89/36.01
2003/0192426 A1 * 10/2003 Peretz ..... B32B 17/10018 89/36.02
2008/0236378 A1 * 10/2008 Sane ..... F41H 5/0428 89/36.02
2009/0133571 A1 * 5/2009 Pfister ..... F41H 5/013 89/36.07
2015/0268009 A1 * 9/2015 Tunis, III ..... B43L 1/00 89/36.02

OTHER PUBLICATIONS

Aegiscontrols. Ballistic Door Panel Level IIIa. Website, www.aegiscontrols.net; originally downloaded May 9, 2019, 2 pages.

* cited by examiner

1/4
5
5/6
6
8
8/10
10
11/22/23
12/22/24

11/22/23
19/48
19/51
5/7
11/22/23
19/49
11/22/23
19/52
20
11/22/23

48
7
53
49
6
5/52

52
7
6
5/48
51

19/52
47
50
19/48
19/51
5/6
20
19/49

52
5/49
7
6
51

6
48
7
5/51
49

19/51
8/10
20
19/48
19/49
19/52

48
10
53
49
9
8/52

52
12/22/24
9
10
8/48
51
12/22/24

19/52
47
20
12/22/24
12/22/24
19/48
50
19/49
12/22/24
19/51
8/9
12/22/24

9
48
10
8/51
49

12/22/24
52
8/49
9
10
12/22/24
51

5/8
11/12/22
19/51
19/48
19/49
19/52
7/10

53
52
48
49
6/9

47
50

54

51

5/8
11/12/22
19/51
7/10
19/48
19/49
19/52

5/8
48
49
53
52
6/9

5/8
52
48
7/10
6/9
51

5/8
47
50
19/48
19/49
19/51

5/8
48
49
51

5/8
52
7/10
6/9
54
51
49

1/4/26

4/29

RELEASABLY ENGAGABLE SYSTEM OF BALLISTIC RESISTANT PANELS

This United States Non-Provisional patent application claims the benefit of U.S. Provisional Patent Application No. 62/279,202, filed Jan. 15, 2016, and U.S. Provisional Patent Application No. 62/278,811, filed Jan. 14, 2016, each hereby incorporated by reference herein.

I. SUMMARY OF THE INVENTION

A broad object of a particular embodiment of the invention can be to provide a releasably engagable system of ballistic-resistant panels, and methods of making and using such a releasably engagable system of ballistic-resistant panels, whereby the releasably engagable system of ballistic-resistant panels includes a first ballistic-resistant panel having opposing first ballistic-resistant panel front and back surfaces; a second ballistic-resistant panel having opposing second ballistic-resistant panel front and back surfaces; a first fastener coupled to the first ballistic-resistant panel; and a second fastener coupled to the second ballistic-resistant panel, whereby the second fastener is configured to releasably engage with the first fastener to fasten the second ballistic-resistant panel front surface to the first ballistic-resistant panel back surface in fixed adjacent relation to provide releasably engaged ballistic-resistant panels.

Another broad object of a particular embodiment of the invention can be to provide a releasably engagable system of ballistic-resistant panels, and methods of making and using such a releasably engagable system of ballistic-resistant panels, whereby the releasably engagable system of ballistic-resistant panels includes a first ballistic-resistant panel having opposing first ballistic-resistant panel front and back surfaces; a second ballistic-resistant panel having opposing second ballistic-resistant panel front and back surfaces; and an adhesive coating coupled to at least one of the first ballistic-resistant panel back surface or the second ballistic-resistant panel front surface, whereby the adhesive coating functions to releasably engage the second ballistic-resistant panel front surface with the first ballistic-resistant panel back surface in fixed adjacent relation to provide releasably engaged ballistic-resistant panels.

Another broad object of a particular embodiment of the invention can be to provide a releasably engagable system of ballistic-resistant panels, and methods of making and using such a releasably engagable system of ballistic-resistant panels, whereby the releasably engagable system of ballistic-resistant panels includes a first ballistic-resistant panel having opposing first ballistic-resistant panel front and back surfaces; a second ballistic-resistant panel having opposing second ballistic-resistant panel front and back surfaces; and a securement element discrete from the first and second ballistic-resistant panels, whereby the securement element functions to releasably secure the second ballistic-resistant panel front surface with the first ballistic-resistant panel back surface in fixed adjacent relation to provide releasably engaged ballistic-resistant panels.

Another broad object of a particular embodiment of the invention can be to provide a ballistic-resistant garment, and methods of making and using such a ballistic-resistant garment, whereby the ballistic-resistant garment includes an embodiment of the releasably engagable system of ballistic-resistant panels; and a garment having a pocket disposed therein, the pocket configured to receive the releasably engaged ballistic-resistant panels to provide the ballistic-resistant garment.

Naturally, further objects of the invention are disclosed throughout other areas of the specification, drawings, and claims.

II. BRIEF DESCRIPTION OF THE DRAWINGS

Figure 13:
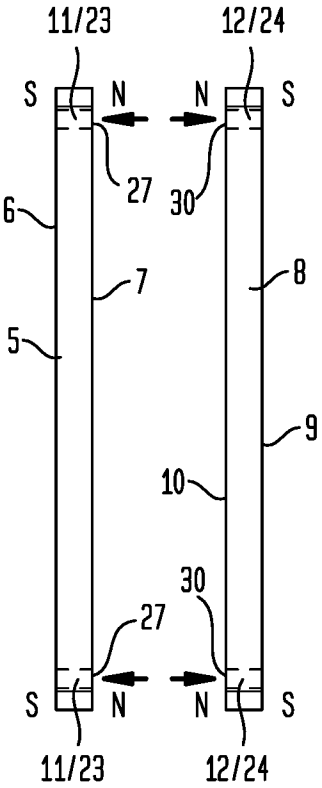

FIG. 13 is a side view of a particular embodiment of the inventive releasably engagable system of ballistic-resistant panels having first and second magnets which are directional to allow fastening in a first configuration and preclude fastening in a second configuration, whereby first and second ballistic-resistant panels cannot releasably engage because the first and second ballistic-resistant panels dispose in the second configuration.

Figure 14B:
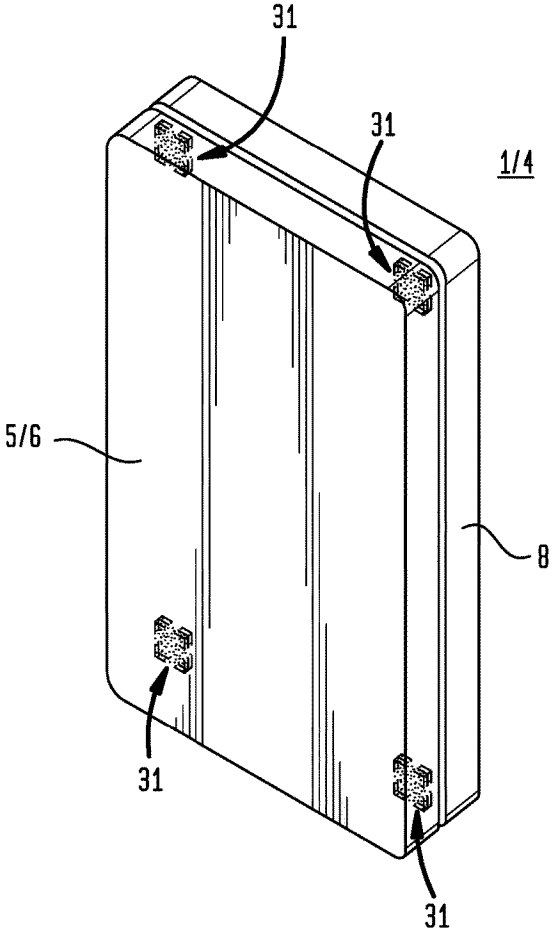
Figure 14A:
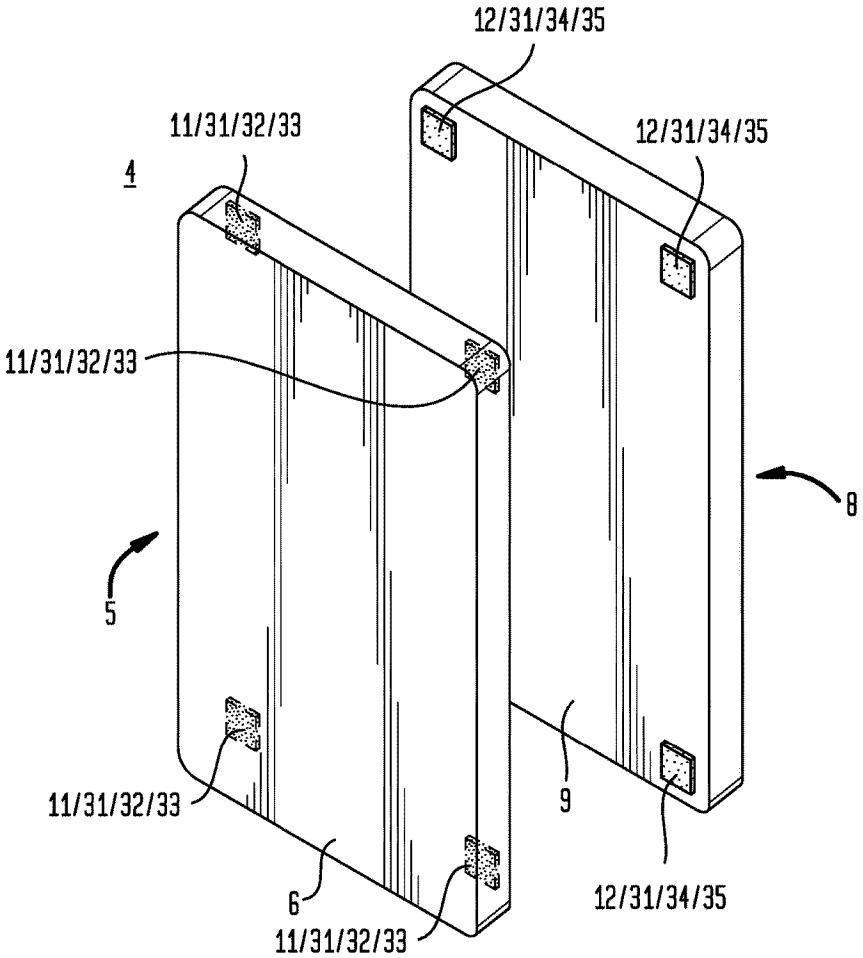

FIG. 14A is a perspective view of a particular embodiment of the inventive releasably engagable system of ballistic-resistant panels having first and second fasteners configured to provide a hook and loop fastening system, whereby first and second ballistic-resistant panels are not releasably engaged in fixed adjacent relation.

FIG. 14B is a perspective view of the first and second ballistic-resistant panels shown in FIG. 14A, but whereby the first and second ballistic-resistant panels are releasably engaged in fixed adjacent relation to provide releasably engaged ballistic-resistant panels.

Figure 15B:
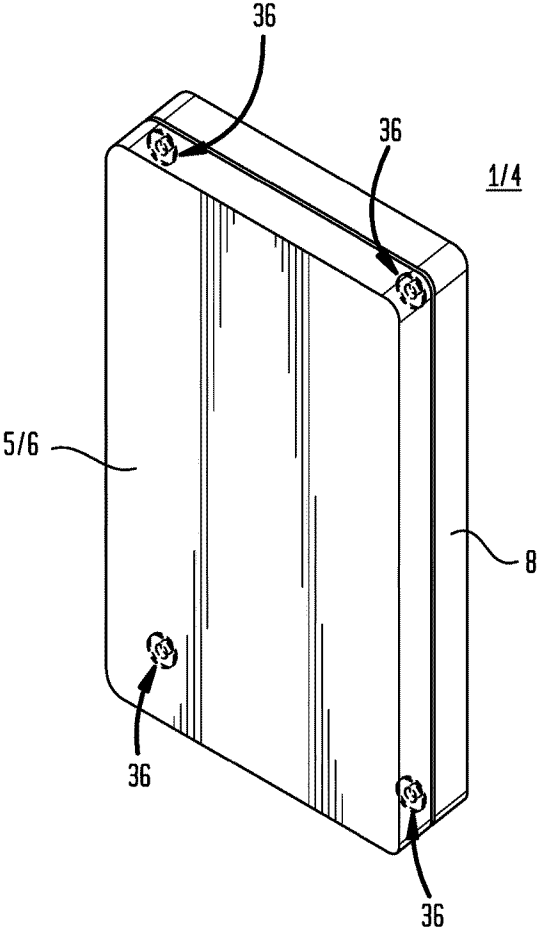
Figure 15A:
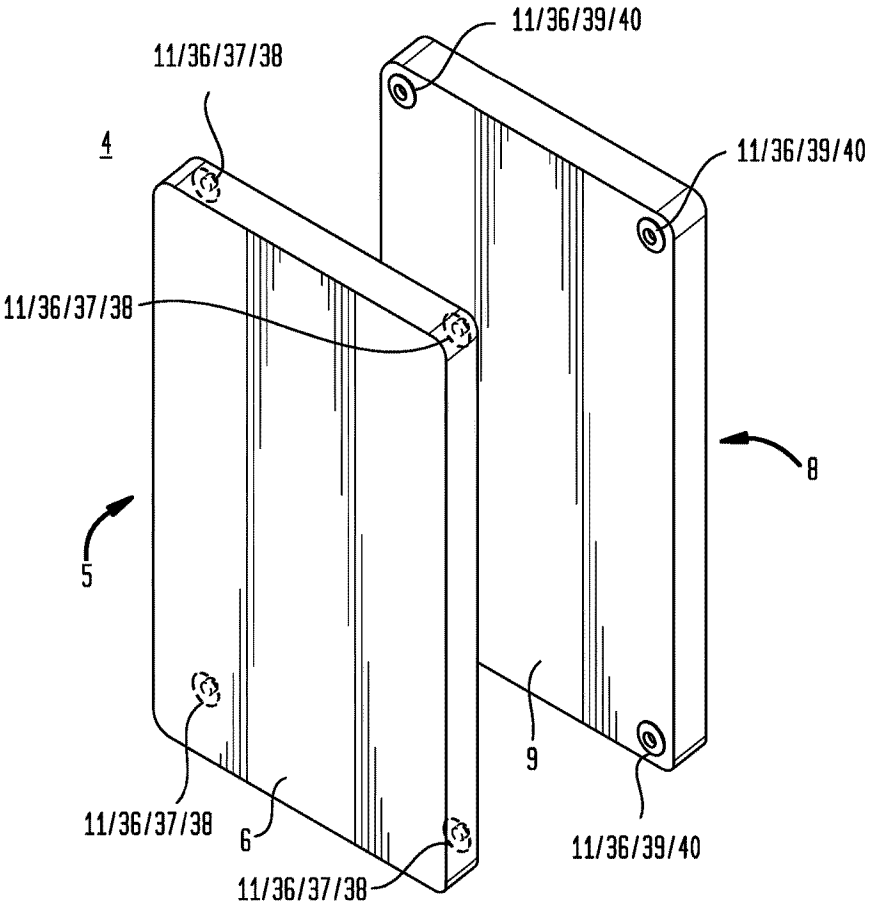

FIG. 15A is a perspective view of a particular embodiment of the inventive releasably engagable system of ballistic-resistant panels having first and second fasteners configured to provide a post-and-socket fastening system, whereby first and second ballistic-resistant panels are not releasably engaged in fixed adjacent relation.

FIG. 15B is a perspective view of the first and second ballistic-resistant panels shown in FIG. 15A, but whereby the first and second ballistic-resistant panels are releasably engaged in fixed adjacent relation to provide releasably engaged ballistic-resistant panels.

Figure 16B:
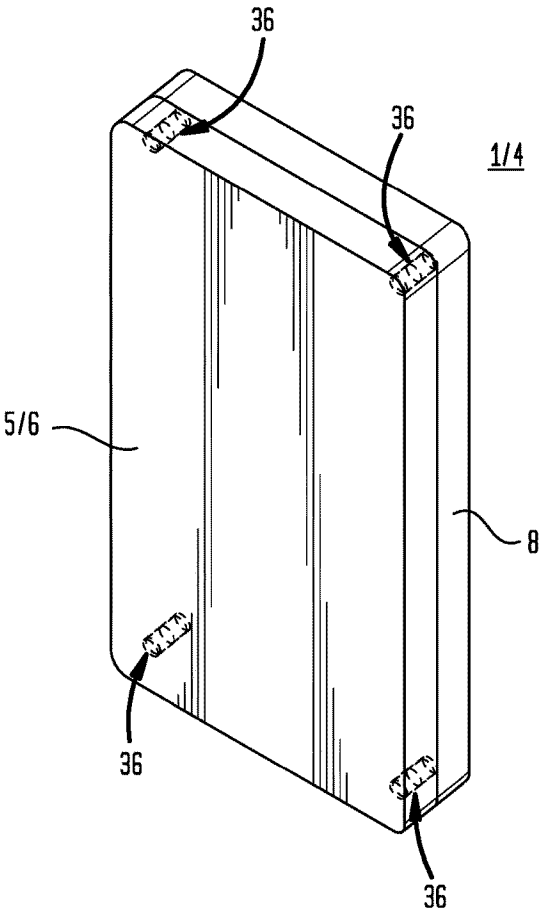
Figure 16A:
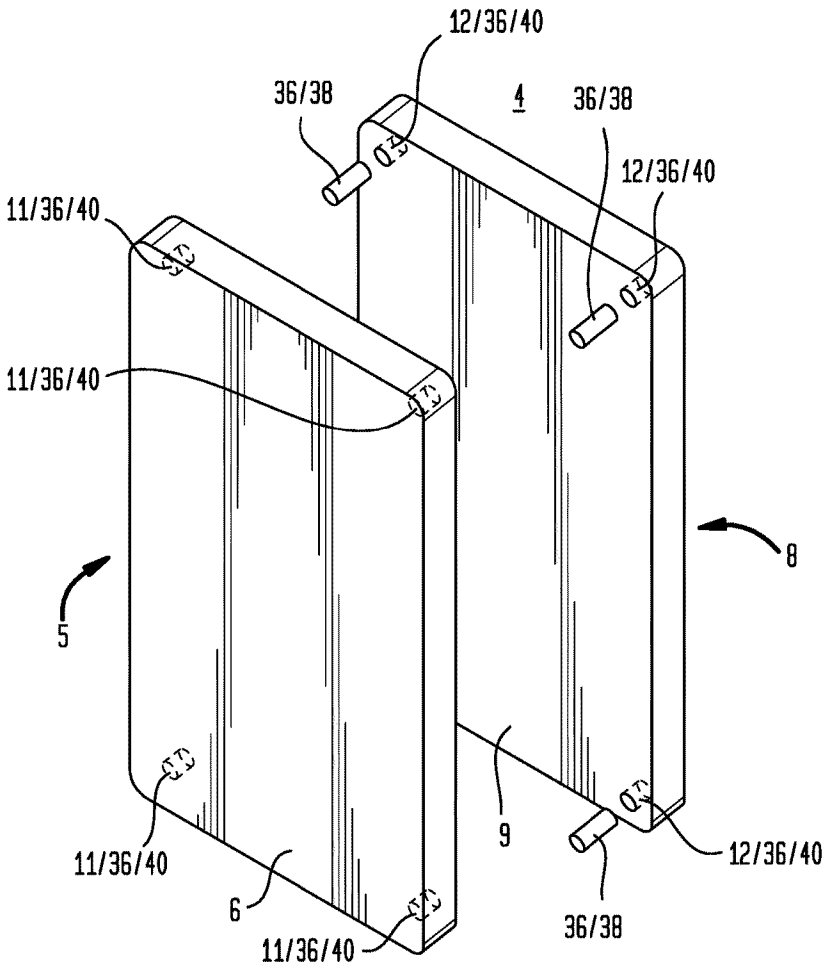

FIG. 16A is a perspective view of a particular embodiment of the inventive releasably engagable system of ballistic-resistant panels having first and second fasteners configured to provide a post-and-socket fastening system, whereby first and second ballistic-resistant panels are not releasably engaged in fixed adjacent relation.

FIG. 16B is a perspective view of the first and second ballistic-resistant panels shown in FIG. 16A, but whereby the first and second ballistic-resistant panels are releasably engaged in fixed adjacent relation to provide releasably engaged ballistic-resistant panels.

Figure 17B:
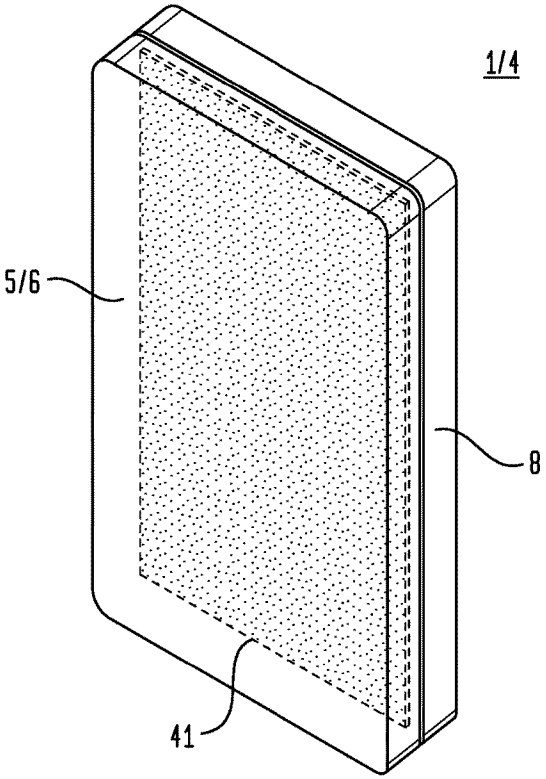
Figure 17A:
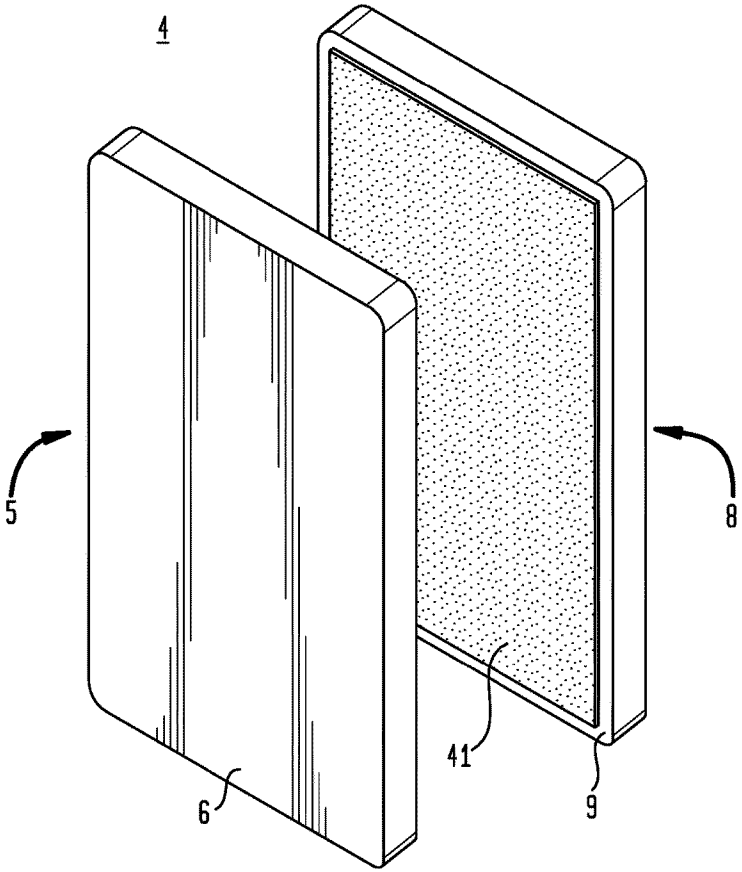

FIG. 17A is a perspective view of a particular embodiment of the inventive releasably engagable system of ballistic-resistant panels having an adhesive coating coupled to a second ballistic-resistant panel front surface, whereby first and second ballistic-resistant panels are not releasably engaged in fixed adjacent relation.

FIG. 17B is a perspective view of the first and second ballistic-resistant panels shown in FIG. 17A, but whereby the first and second ballistic-resistant panels are releasably engaged in fixed adjacent relation to provide releasably engaged ballistic-resistant panels.

Figure 18B:
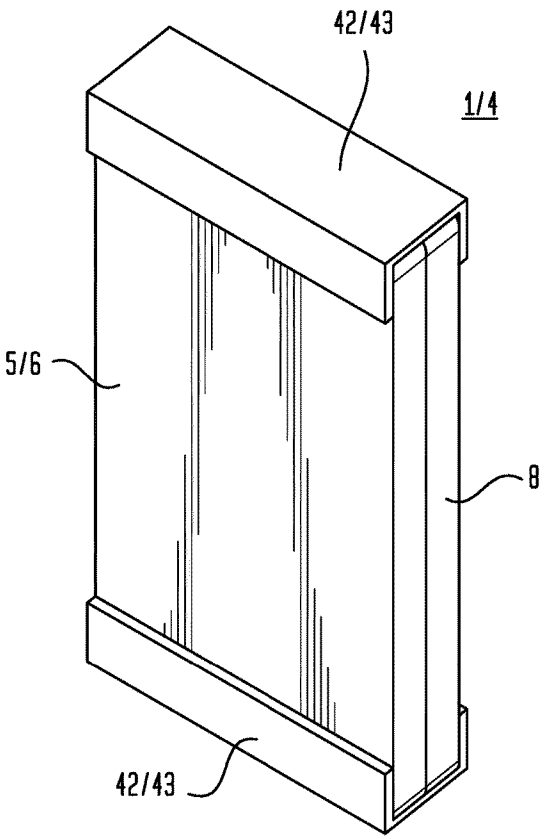
Figure 18A:
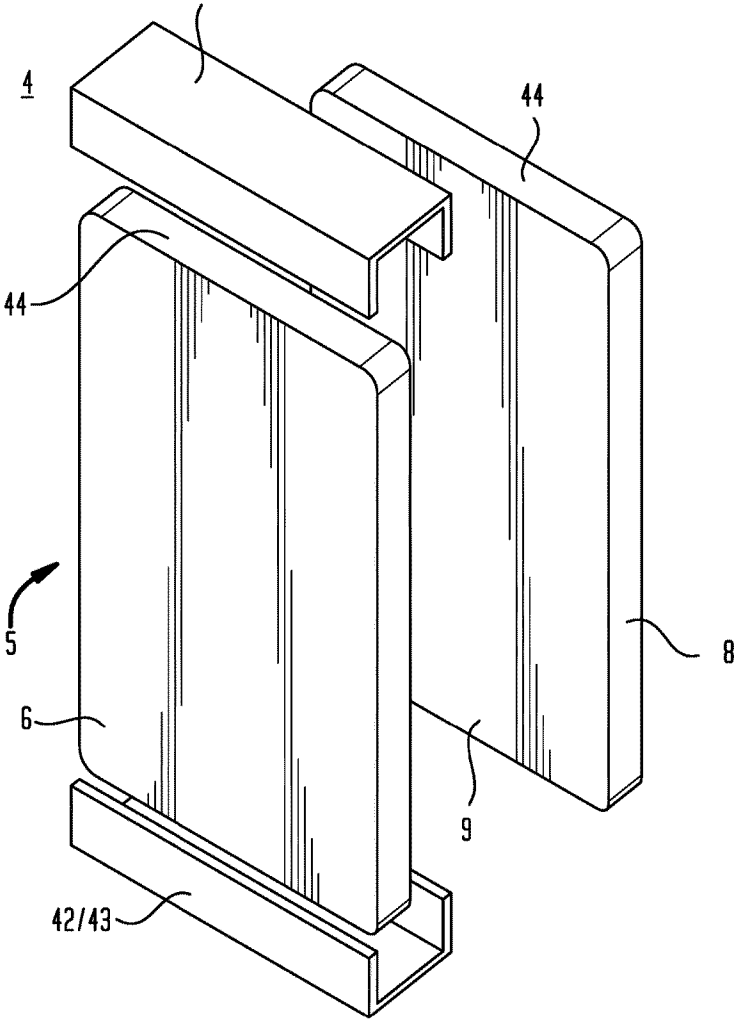

FIG. 18A is a perspective view of a particular embodiment of the inventive releasably engagable system of ballistic-resistant panels having a securement element configured as a channel, whereby first and second ballistic-resistant panels are not releasably engaged in fixed adjacent relation.

FIG. 18B is a perspective view of the first and second ballistic-resistant panels shown in FIG. 18A, but whereby the first and second ballistic-resistant panels are releasably engaged in fixed adjacent relation to provide releasably engaged ballistic-resistant panels.

Figure 19A:
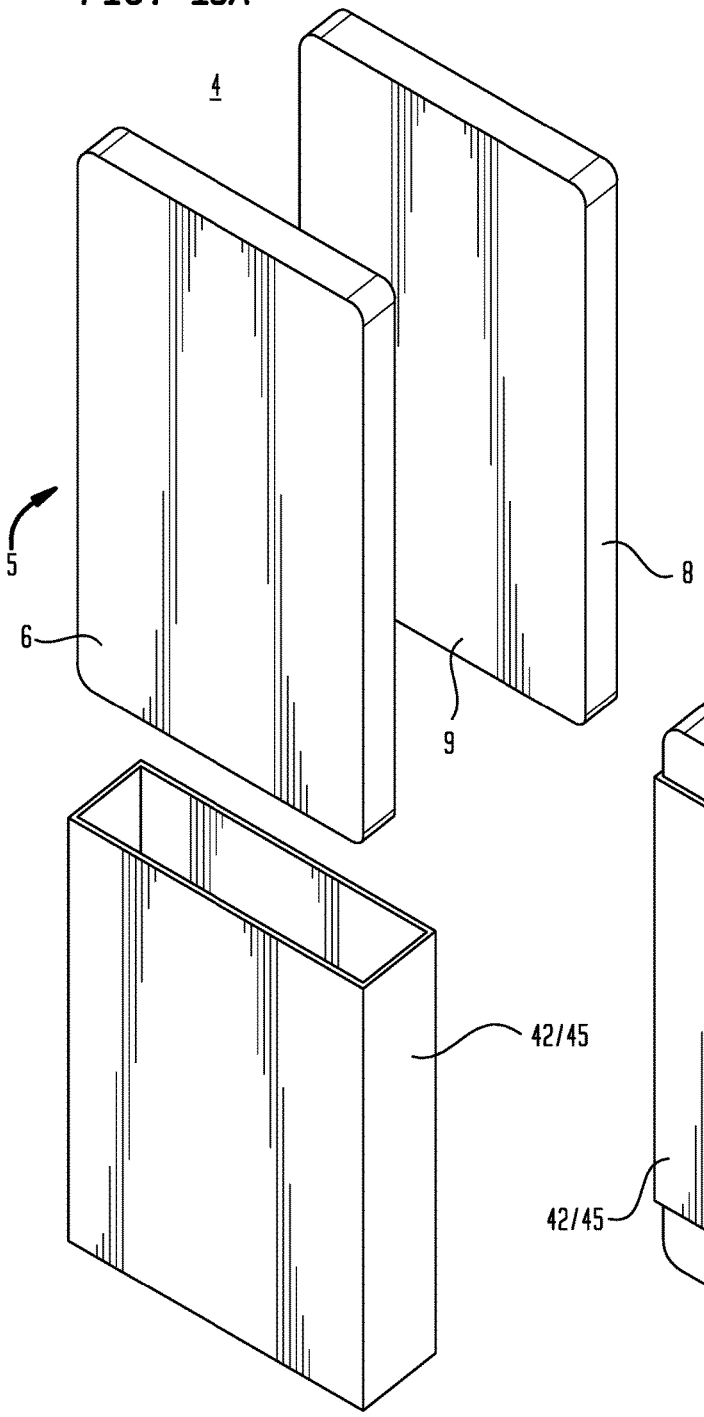

FIG. 19A is a perspective view of a particular embodiment of the inventive releasably engagable system of ballistic-resistant panels having a securement element configured as a resiliently stretchable member, whereby first and second ballistic-resistant panels are not releasably engaged in fixed adjacent relation.

Figure 19B:
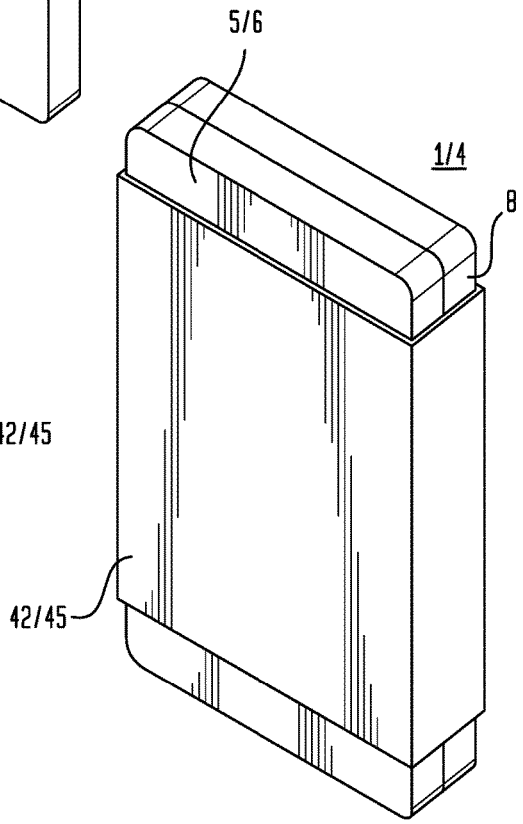

FIG. 19B is a perspective view of the first and second ballistic-resistant panels shown in FIG. 19A, but whereby the first and second ballistic-resistant panels are releasably engaged in fixed adjacent relation to provide releasably engaged ballistic-resistant panels.

III. DETAILED DESCRIPTION OF THE INVENTION

Figure 1:
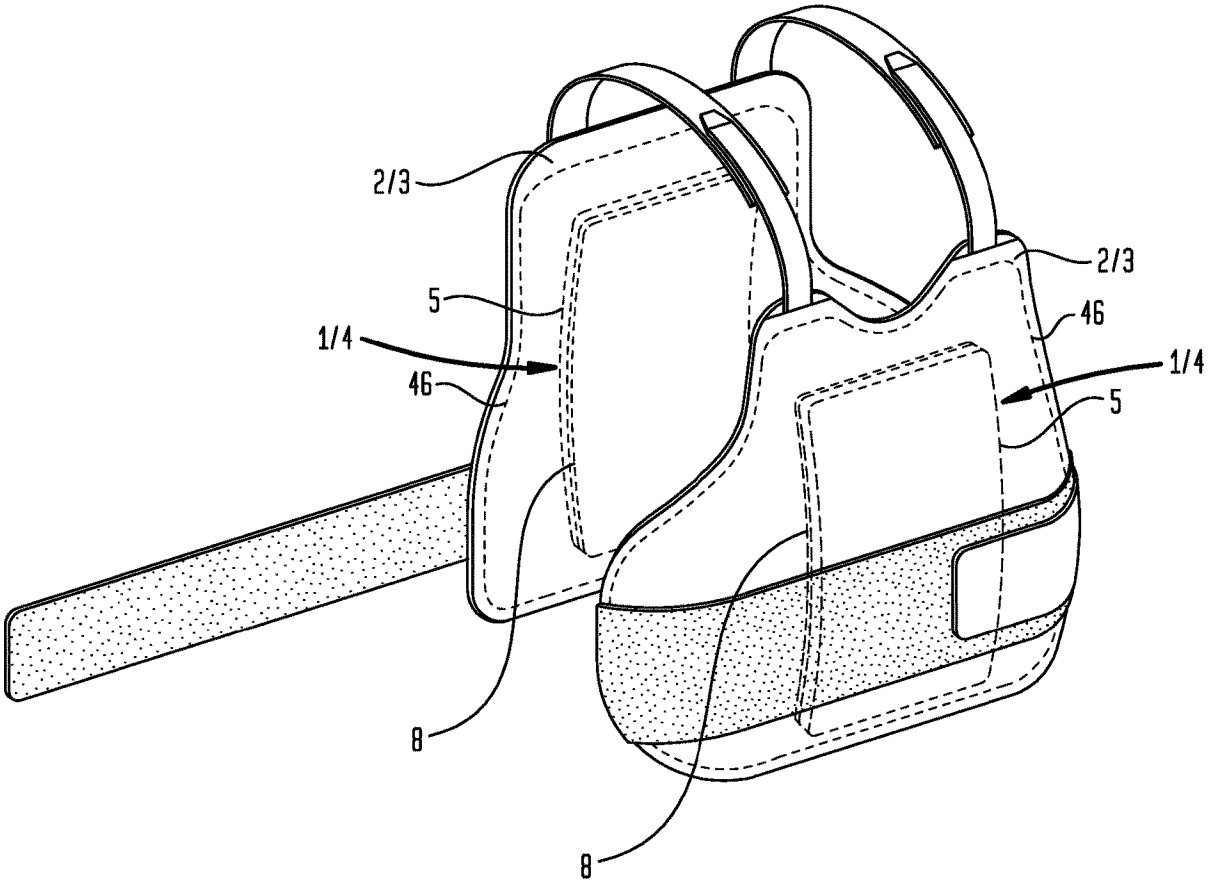
FIG. 1 is an illustration of a method of using a particular embodiment of the inventive releasably engagable system of ballistic-resistant panels, whereby releasably engaged ballistic-resistant panels are disposed in a garment to provide a ballistic-resistant garment which may be worn to protect a wearer from ballistic threats.

Now referring primarily to FIG. 1, which illustrates a method of using a particular embodiment of releasably engaged ballistic-resistant panels (1) for disposition within a garment (2) to provide a ballistic-resistant garment (3) which may be worn to protect a wearer from ballistic threats, whereby the inventive releasably engagable system of ballistic-resistant panels (4) includes a first ballistic-resistant panel (5) having opposing first ballistic-resistant panel front and back surfaces (6)(7) and a second ballistic-resistant panel (8) having opposing second ballistic-resistant panel front and back surfaces (9)(10).

Further, the releasably engagable system of ballistic-resistant panels (4) includes a first fastener (11) coupled to the first ballistic-resistant panel (5) and a second fastener (12) coupled to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

The term "panel" for the purposes of this invention means any three-dimensionally shaped object, whether flat (planar) or contoured (arcuate), which can have any applicable perimeter shape, whether regular or irregular.

The term "fixed" for the purposes of this invention means attached in a way that generally precludes movement.

The term "adjacent" for the purposes of this invention means close to, near, next to, or the like, whereby there may or may not be contact between adjacent elements, depending upon the application.

Now referring primarily to FIG. 2A through FIG. 4H, the releasably engagable system of ballistic-resistant panels (4) includes a first ballistic-resistant panel (5) having opposing first ballistic-resistant panel front and back surfaces (6)(7) (as shown in the examples of FIG. 3A through FIG. 3G) and a second ballistic-resistant panel (8) having opposing second ballistic-resistant panel front and back surfaces (9)(10) (as shown in the examples of FIG. 4A through FIG. 4G), whereby the ballistic-resistant panels (5)(8) are capable of slowing or stopping one or more threats, such as a high velocity projectile or ballistic threat, for example via one or more energy-absorbing mechanisms. The ballistic-resistant panels (5)(8) can be generally rigid, semi-rigid, flexible, or combinations thereof, depending upon the application.

Figure 3B:
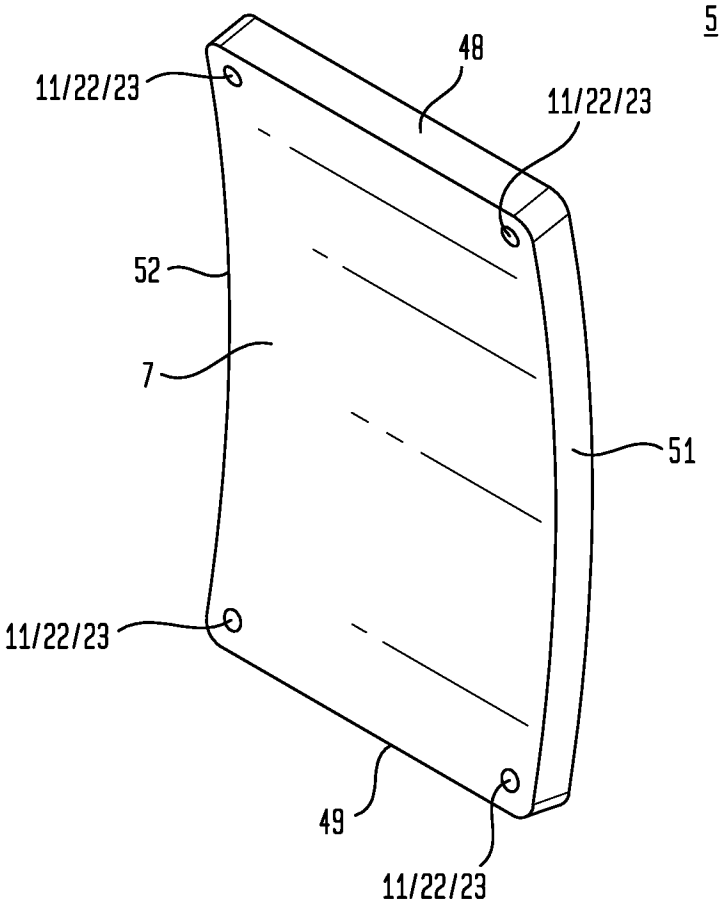
FIG. 3B is a perspective view of a back of the particular embodiment of the first ballistic-resistant panel shown in FIG. 3A.
Figure 3A:
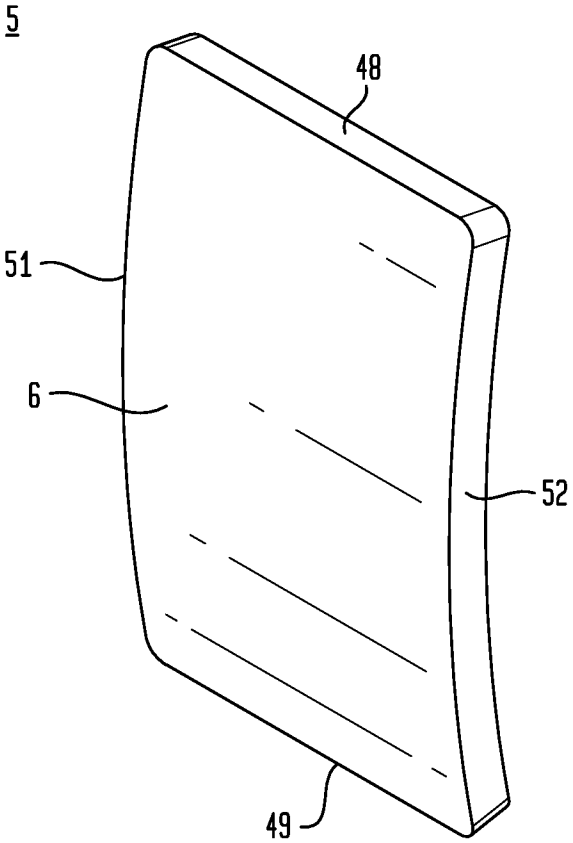
FIG. 3A is a perspective view of a front of a particular embodiment of a first ballistic-resistant panel of the inventive releasably engagable system of ballistic-resistant panels.
Figures 3C, 3D, 3E, 3F, 3G, 3H, 5A:
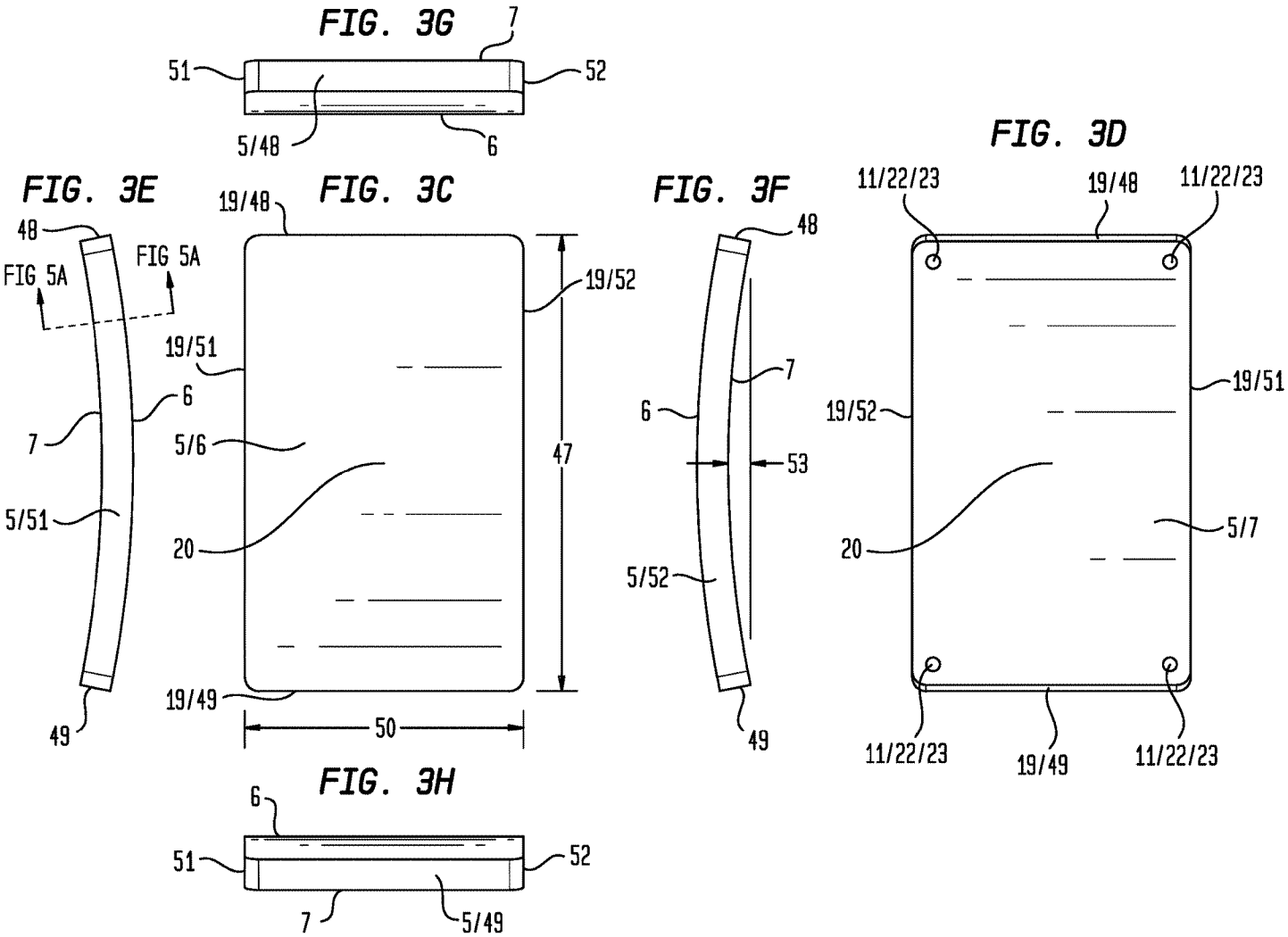
FIG. 3C is a front view of the particular embodiment of the first ballistic-resistant panel shown in FIG. 3A.
FIG. 3D is a rear view of the particular embodiment of the first ballistic-resistant panel shown in FIG. 3A.
FIG. 3E is a left side view of the particular embodiment of the first ballistic-resistant panel shown in FIG. 3A.
FIG. 3F is a right side view of the particular embodiment of the first ballistic-resistant panel shown in FIG. 3A.
FIG. 3G is a top view of the particular embodiment of the first ballistic-resistant panel shown in FIG. 3A.
FIG. 3H is a bottom view of the particular embodiment of the first ballistic-resistant panel shown in FIG. 3A.
FIG. 5A is a cross-sectional view of the particular embodiment of the first ballistic-resistant panel shown in FIG. 3E, whereby a plurality of ballistic-resistant sheets form the first ballistic-resistant panel.
Figure 4B:
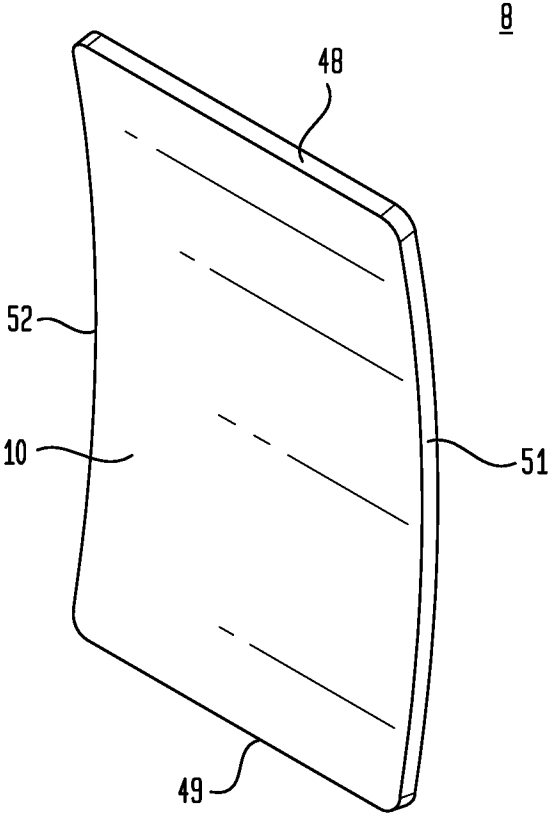
FIG. 4B is a perspective view of a back of the particular embodiment of the second ballistic-resistant panel shown in FIG. 4A.
Figure 4A:
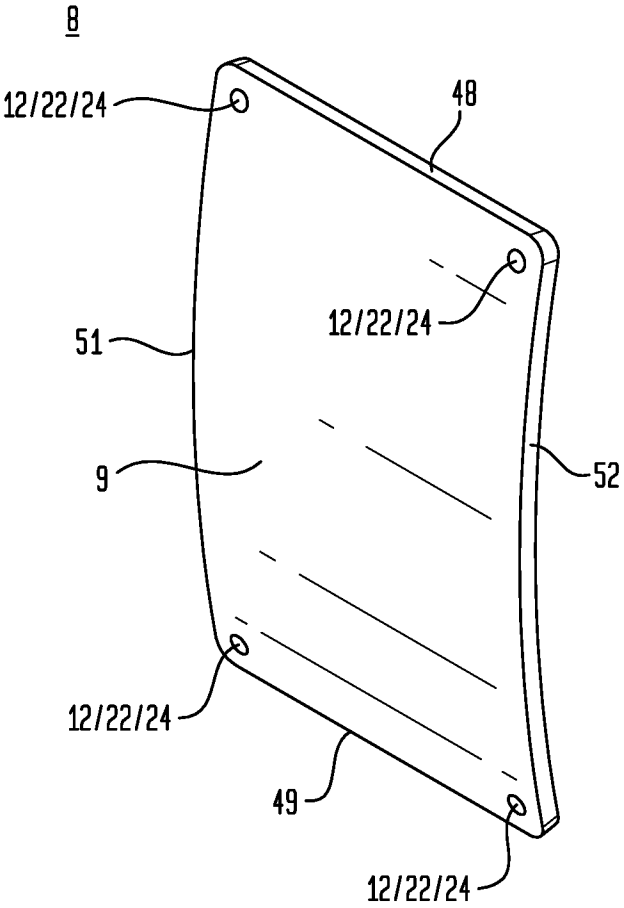
FIG. 4A is a perspective view of a front of a particular embodiment of a second ballistic-resistant panel of the inventive releasably engagable system of ballistic-resistant panels.
Figures 4C, 4D, 4E, 4F, 4G, 4H, 5B:
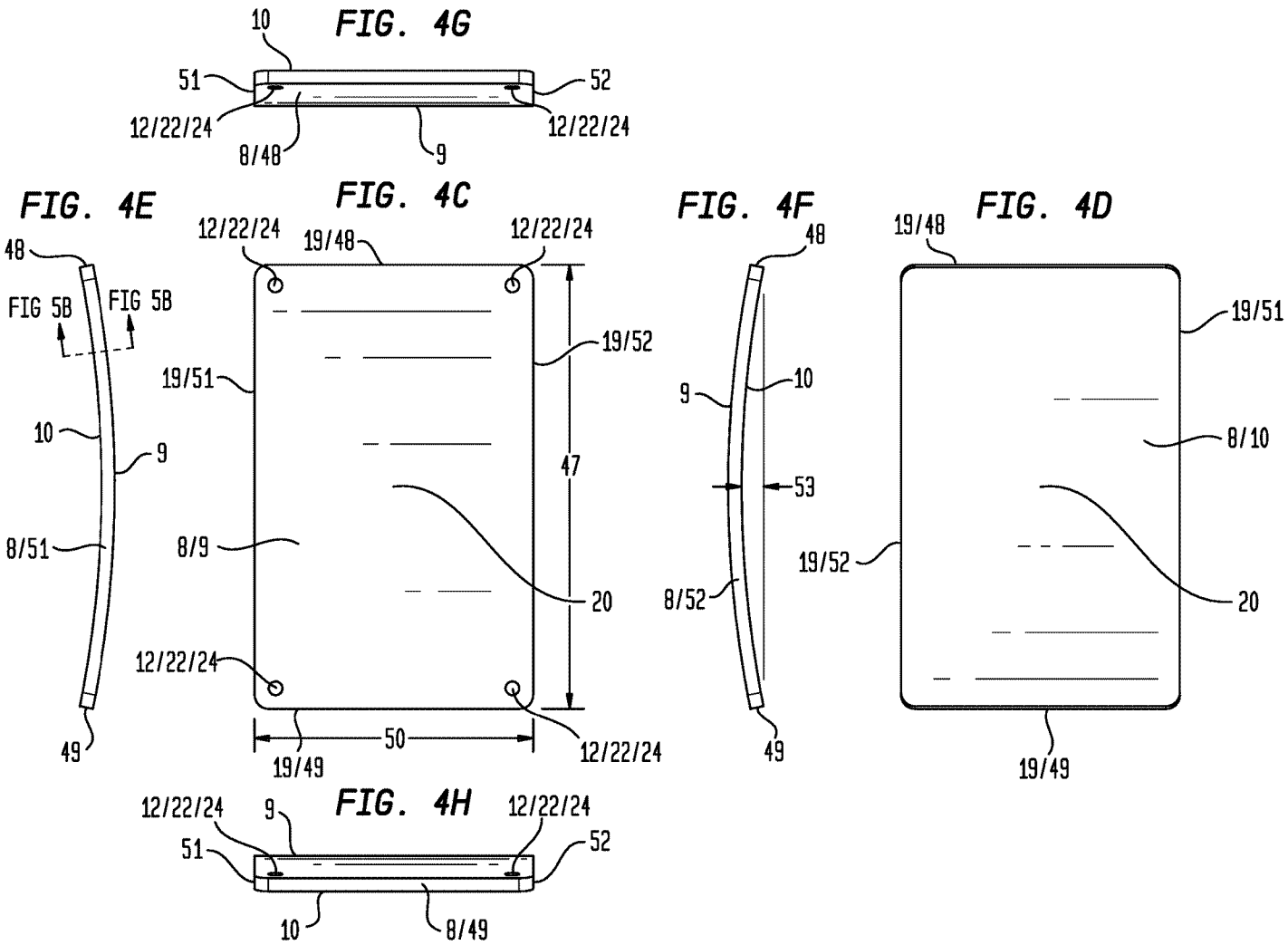
FIG. 4C is a front view of the particular embodiment of the second ballistic-resistant panel shown in FIG. 4A.
FIG. 4D is a rear view of the particular embodiment of the second ballistic-resistant panel shown in FIG. 4A.
FIG. 4E is a left side view of the particular embodiment of the second ballistic-resistant panel shown in FIG. 4A.
FIG. 4F is a right side view of the particular embodiment of the second ballistic-resistant panel shown in FIG. 4A.
FIG. 4G is a top view of the particular embodiment of the second ballistic-resistant panel shown in FIG. 4A.
FIG. 4H is a bottom view of the particular embodiment of the second ballistic-resistant panel shown in FIG. 4A.
FIG. 5B is a cross-sectional view of the particular embodiment of the second ballistic-resistant panel shown in FIG. 4E, whereby a plurality of ballistic-resistant sheets form the second ballistic-resistant panel.
Figure 5A:
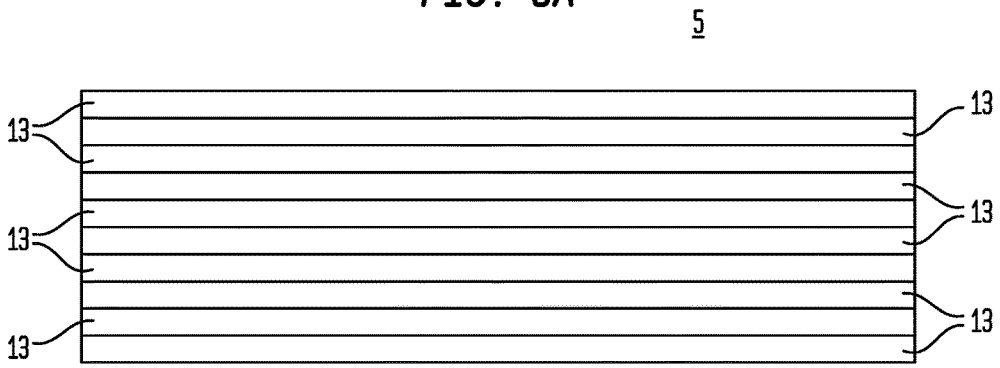
Figure 5B:
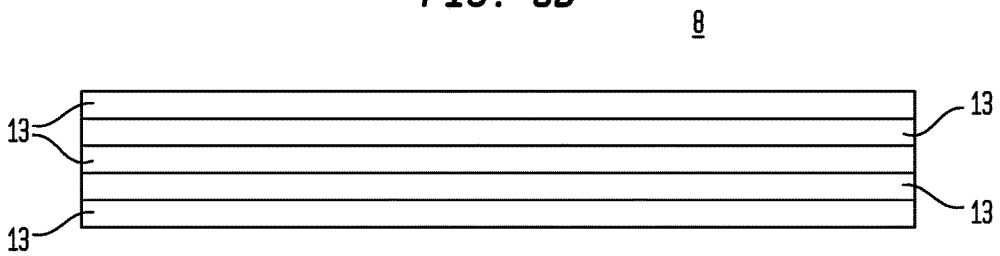
Figure 6A:
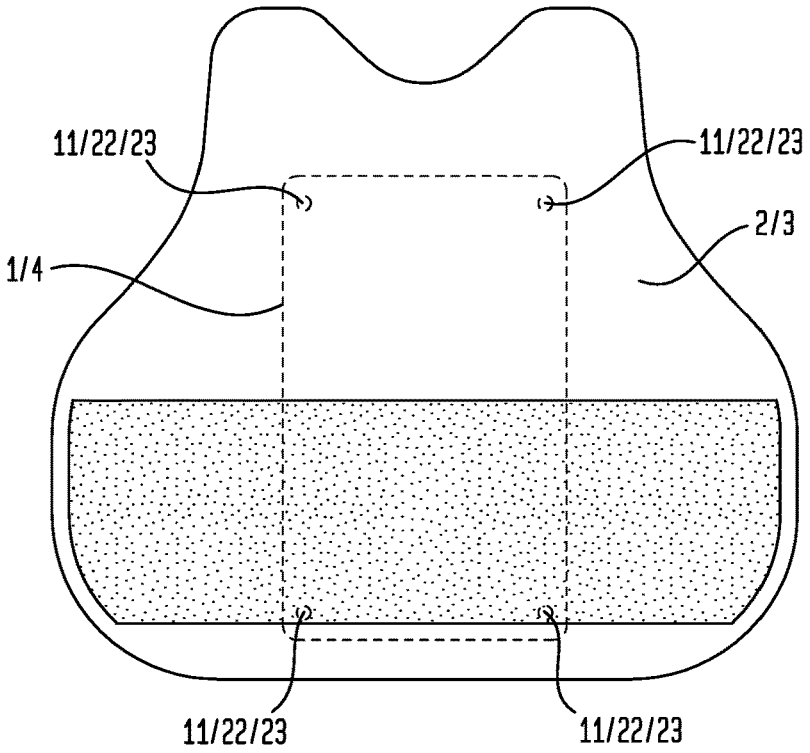
FIG. 6A is a front view of a garment in which releasably engaged ballistic-resistant panels are disposed to provide a ballistic-resistant garment.
Figure 6B:
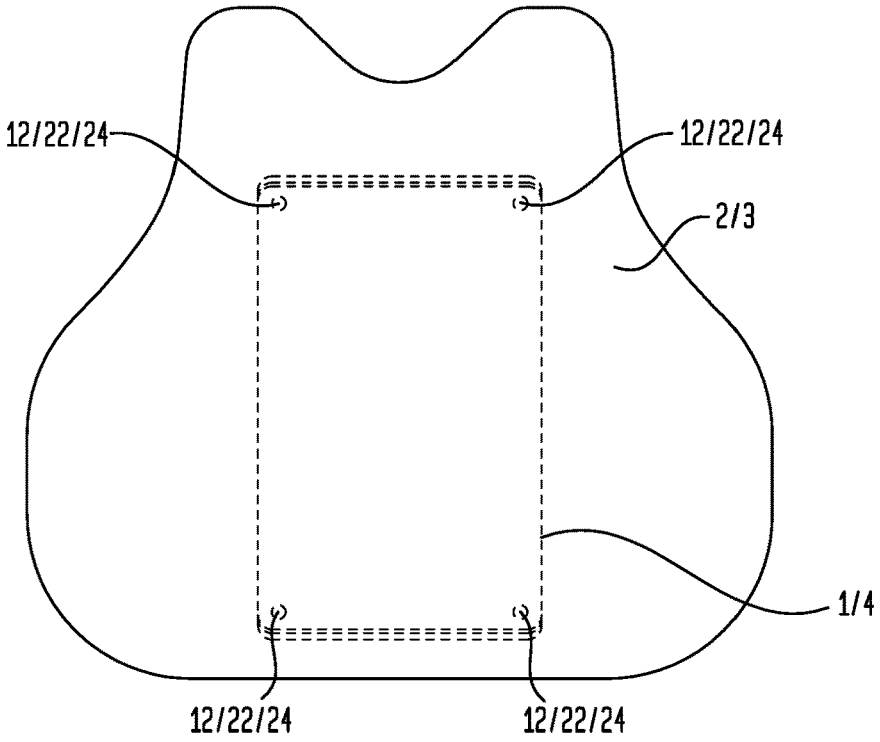
FIG. 6B is a rear view of the ballistic-resistant garment shown in FIG. 6A.
Figure 6C:
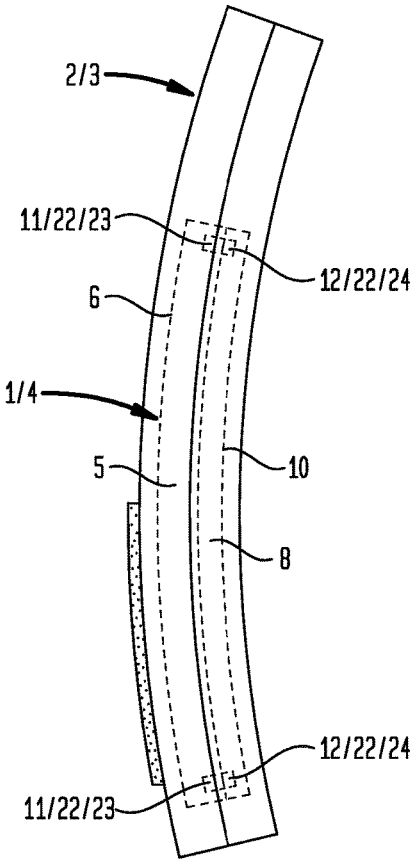
FIG. 6C is a right side view of the ballistic-resistant garment shown in FIG. 6A.
Figure 6D:
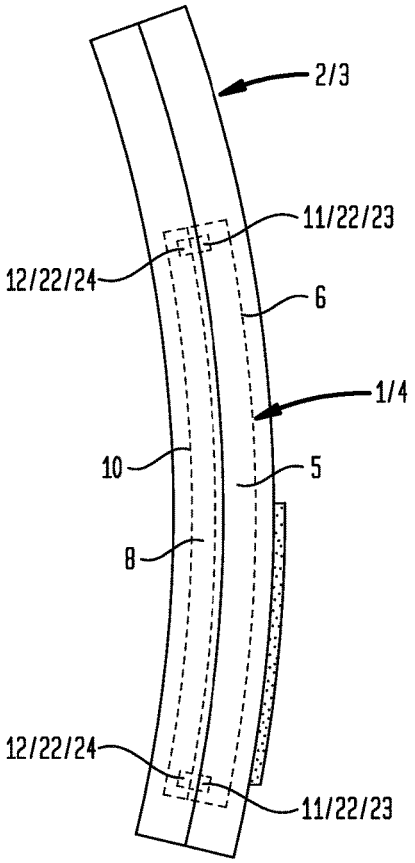
FIG. 6D is a left side view of the ballistic-resistant garment shown in FIG. 6A.
Figure 6E:
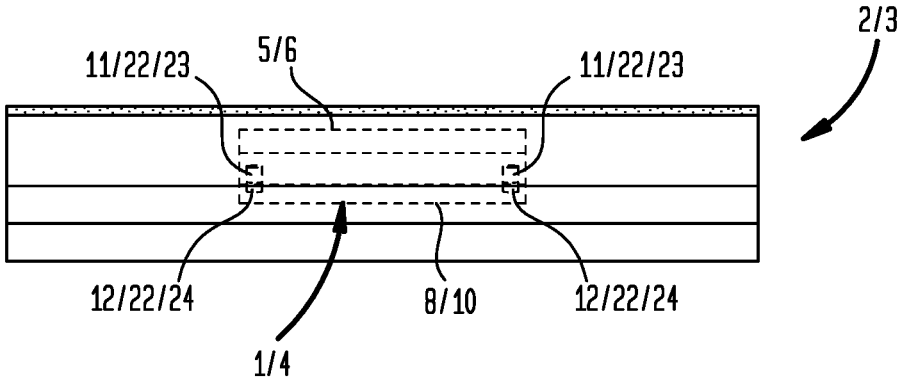
FIG. 6E is a top view of the ballistic-resistant garment shown in FIG. 6A.
Figure 6F:
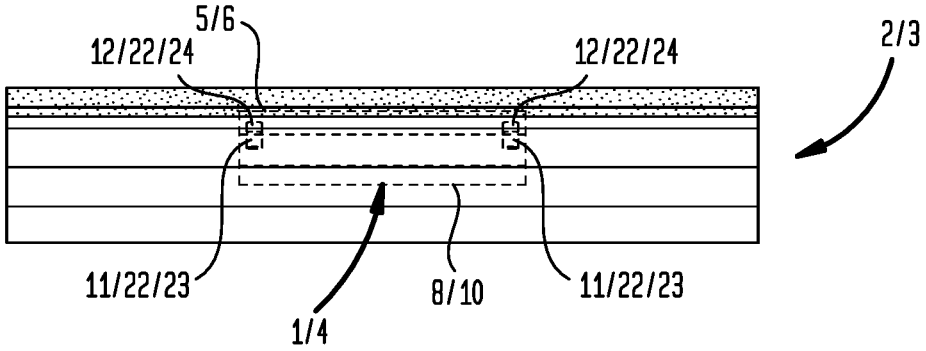
FIG. 6F is a bottom view of the ballistic-resistant garment shown in FIG. 6A.
Figure 7B:
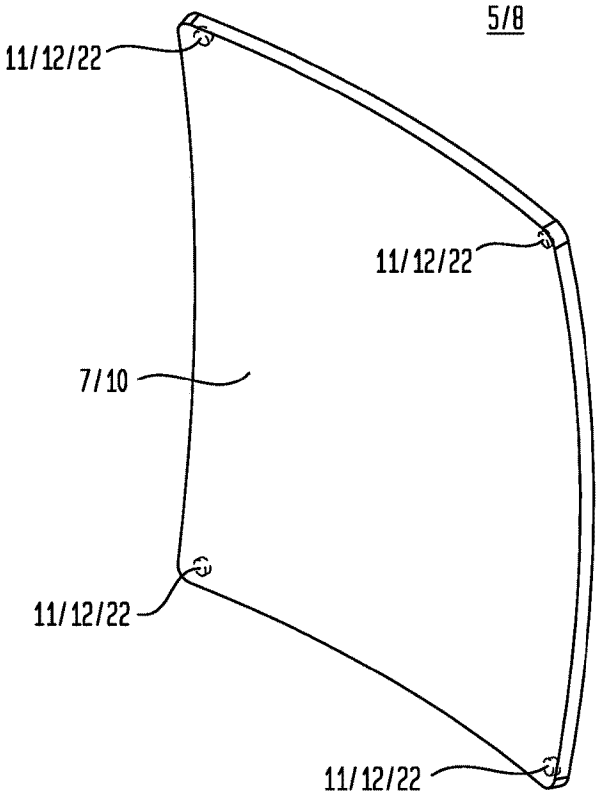
FIG. 7B is a perspective view of a back of the particular embodiment of the ballistic-resistant panel shown in FIG. 7A.
Figure 7A:
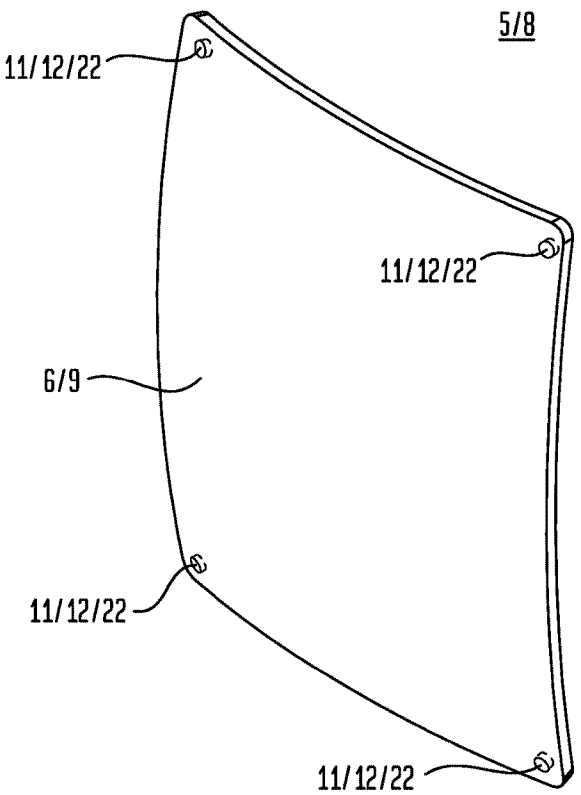
FIG. 7A is a perspective view of a front of a particular embodiment of a ballistic-resistant panel of the inventive releasably engagable system of ballistic-resistant panels.
Figures 7C, 7D, 7E, 7F, 7G, 7H:
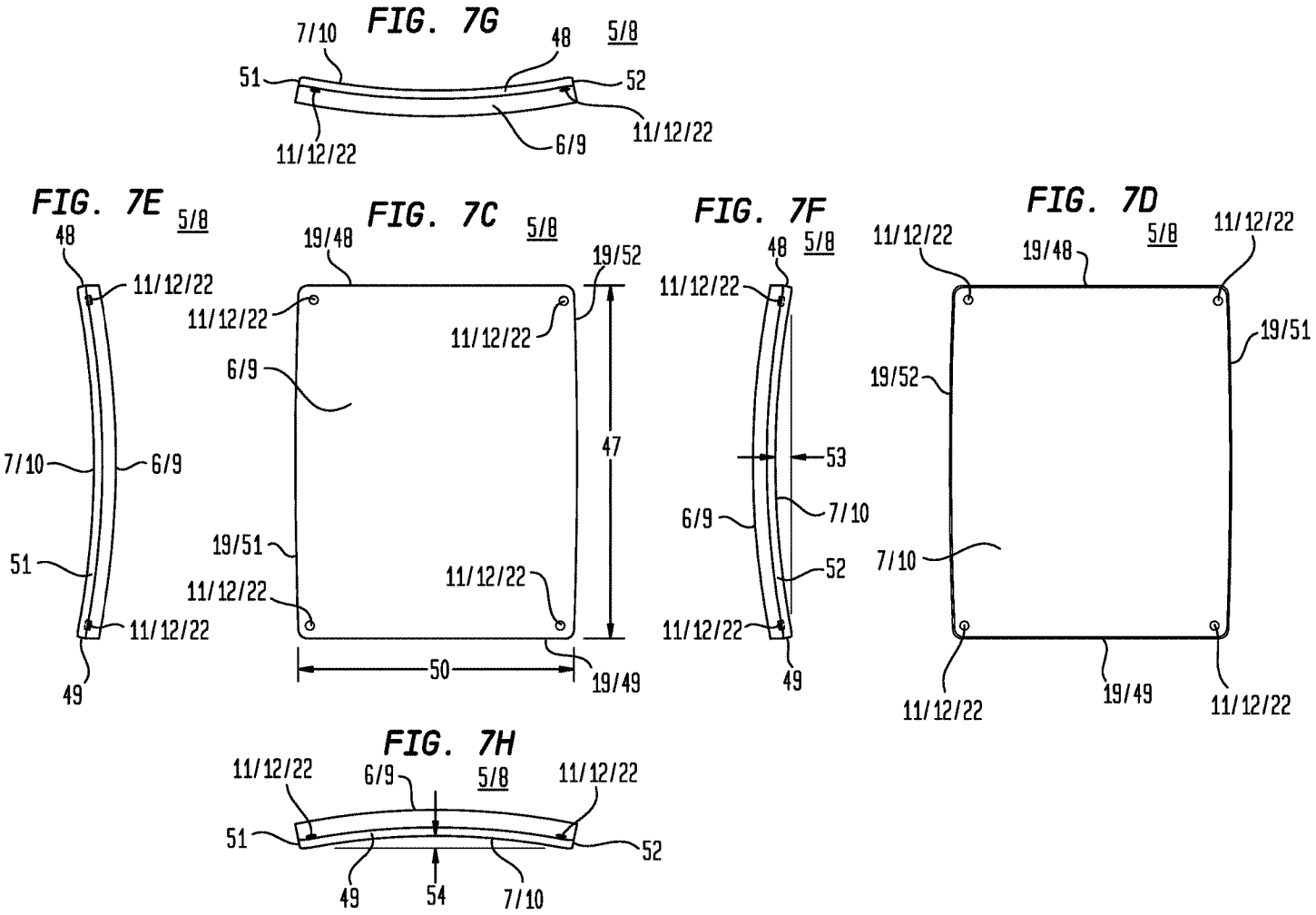
FIG. 7C is a front view of the particular embodiment of the ballistic-resistant panel shown in FIG. 7A.
FIG. 7D is a rear view of the particular embodiment of the ballistic-resistant panel shown in FIG. 7A.
FIG. 7E is a left side view of the particular embodiment of the ballistic-resistant panel shown in FIG. 7A.
FIG. 7F is a right side view of the particular embodiment of the ballistic-resistant panel shown in FIG. 7A.
FIG. 7G is a top view of the particular embodiment of the ballistic-resistant panel shown in FIG. 7A.
FIG. 7H is a bottom view of the particular embodiment of the ballistic-resistant panel shown in FIG. 7A.
Figure 8B:
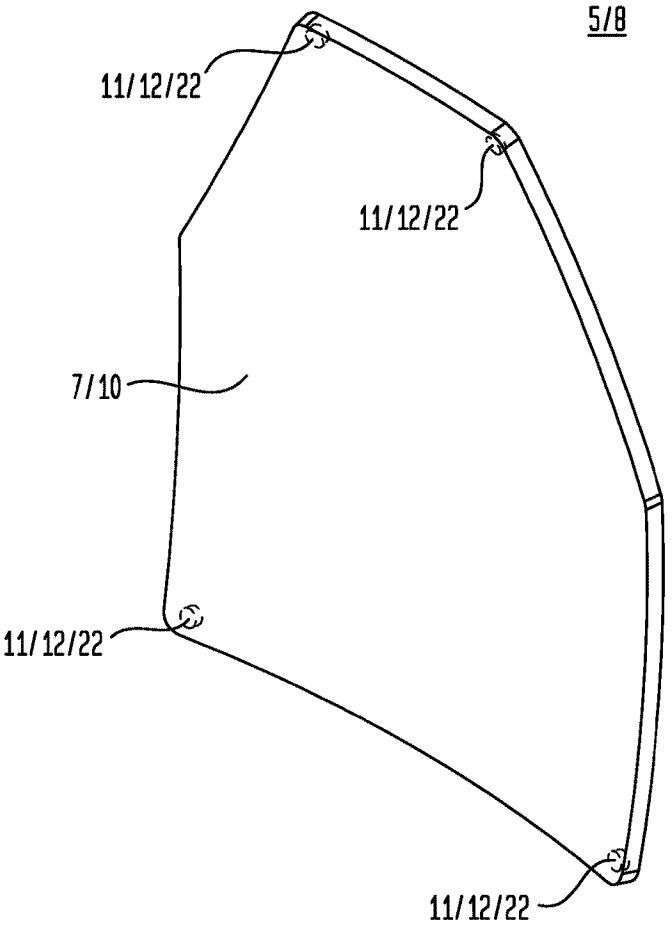
FIG. 8B is a perspective view of a back of the particular embodiment of the ballistic-resistant panel shown in FIG. 8A.
Figure 8A:
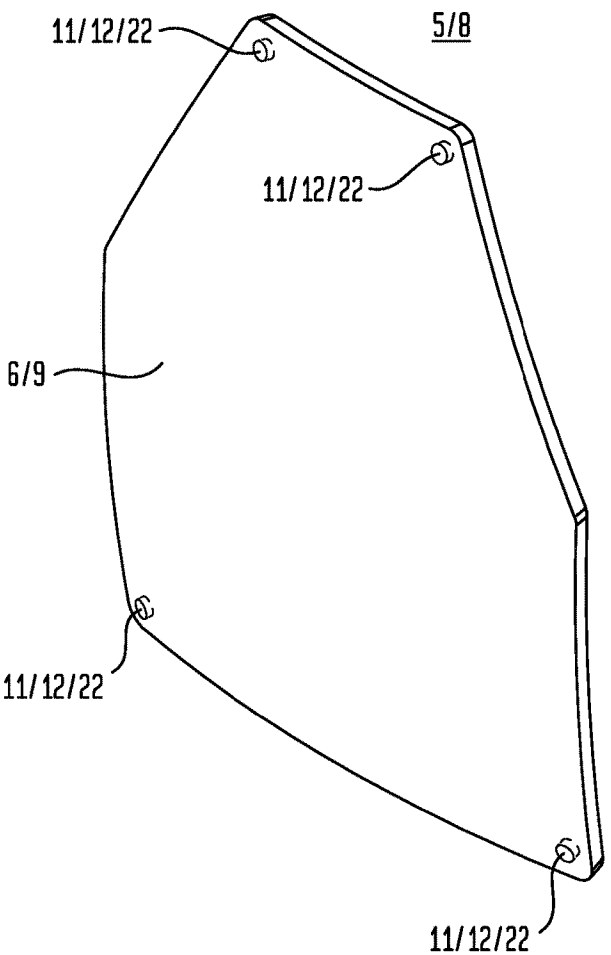
FIG. 8A is a perspective view of a front of a particular embodiment of a ballistic-resistant panel of the inventive releasably engagable system of ballistic-resistant panels.
Figures 8C, 8D, 8E, 8F, 8G, 8H:
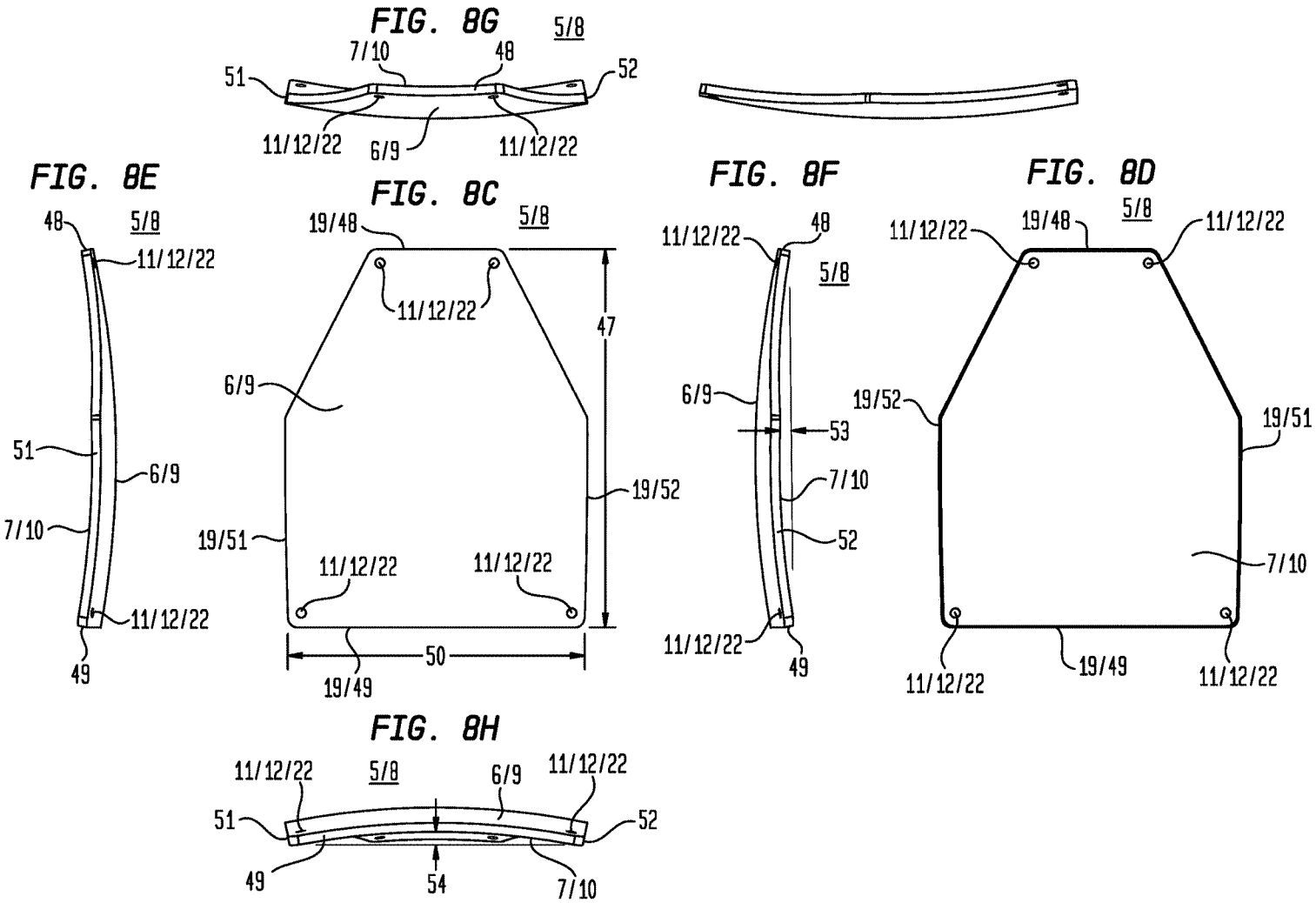
FIG. 8C is a front view of the particular embodiment of the ballistic-resistant panel shown in FIG. 8A.
FIG. 8D is a rear view of the particular embodiment of the ballistic-resistant panel shown in FIG. 8A.
FIG. 8E is a left side view of the particular embodiment of the ballistic-resistant panel shown in FIG. 8A.
FIG. 8F is a right side view of the particular embodiment of the ballistic-resistant panel shown in FIG. 8A.
FIG. 8G is a top view of the particular embodiment of the ballistic-resistant panel shown in FIG. 8A.
FIG. 8H is a bottom view of the particular embodiment of the ballistic-resistant panel shown in FIG. 8A.

Now referring primarily to FIG. 5A and FIG. 5B, as to particular embodiments, the ballistic-resistant panel (5)(8) can be formed from one or more anti-ballistic sheets (13), whereby an anti-ballistic sheet (13) can comprise any of a numerous and wide variety of materials, such as metal, fiberglass, composite material, polymeric material, or the like, or combinations thereof. As non-limiting examples of the latter, polymeric materials can include aramid fibers, para-aramid fibers, meta-aramid fibers, polyolefins, and thermoplastic polyethylenes, such as ultra-high-molecular-weight polyethylenes (UHMWPE).

As but one illustrative example, the anti-ballistic sheet (13) can comprise a woven or non-woven assembly of a plurality of fibers bonded by a resin, such as a thermoplastic polymer, a thermoset polymer, an elastic resin, or the like, or combinations thereof, whereby the resin may coat the anti-ballistic sheet (13) or be impregnated within the anti-ballistic sheet (13), depending upon the application.

To make a ballistic-resistant panel (5)(8), a stack of anti-ballistic sheets (13) can be heated to a temperature proximate the melting point of the resin, thereby softening the resin to promote partial or full bonding of adjacent anti-ballistic sheets (13) to provide the ballistic-resistant panel (5)(8). Further, as to particular embodiments, pressure can be applied to the stack of anti-ballistic sheets (13) with the softened resin to promote the partial or full bonding of adjacent anti-ballistic sheets (13) to provide the ballistic-resistant panel (5)(8).

Again referring primarily to FIG. 2A through FIG. 4H, the releasably engagable system of ballistic-resistant panels (4)

further includes a first fastener (11) coupled to the first ballistic-resistant panel (5) and a second fastener (12) coupled to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1).

Figure 2B:
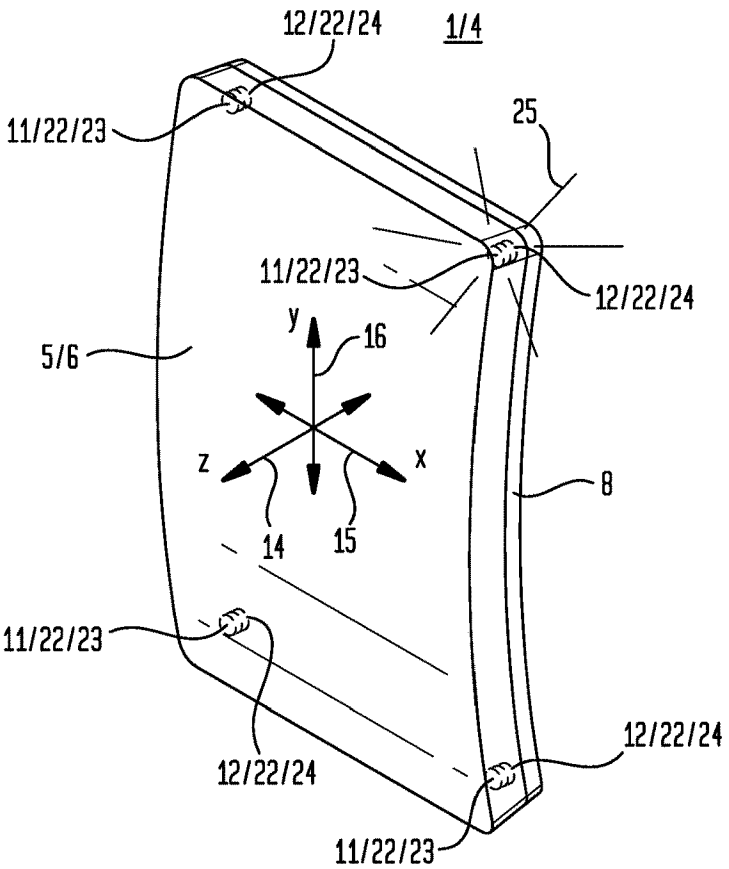
FIG. 2B is a perspective view of the first and second ballistic-resistant panels shown in FIG. 2A, but whereby the first and second ballistic-resistant panels are releasably engaged in fixed adjacent relation to provide releasably engaged ballistic-resistant panels.
Figure 2A:
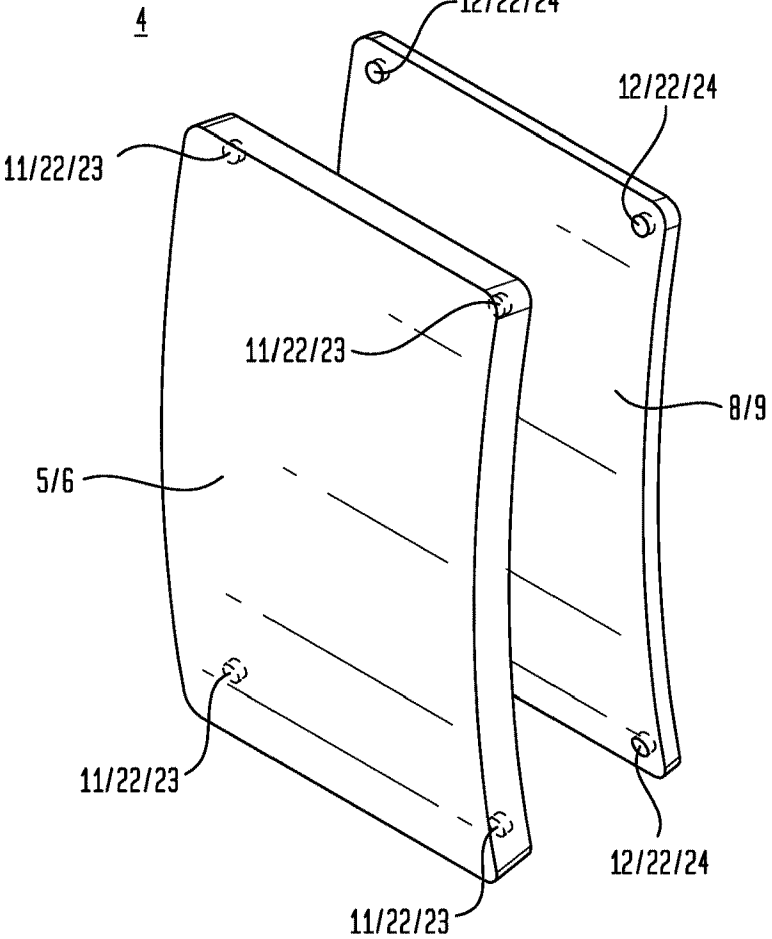
FIG. 2A is a perspective view of a particular embodiment of the inventive releasably engagable system of ballistic-resistant panels, whereby first and second ballistic-resistant panels are not releasably engaged in fixed adjacent relation.
Figures 2C, 2D, 2E, 2F, 2G, 2H:
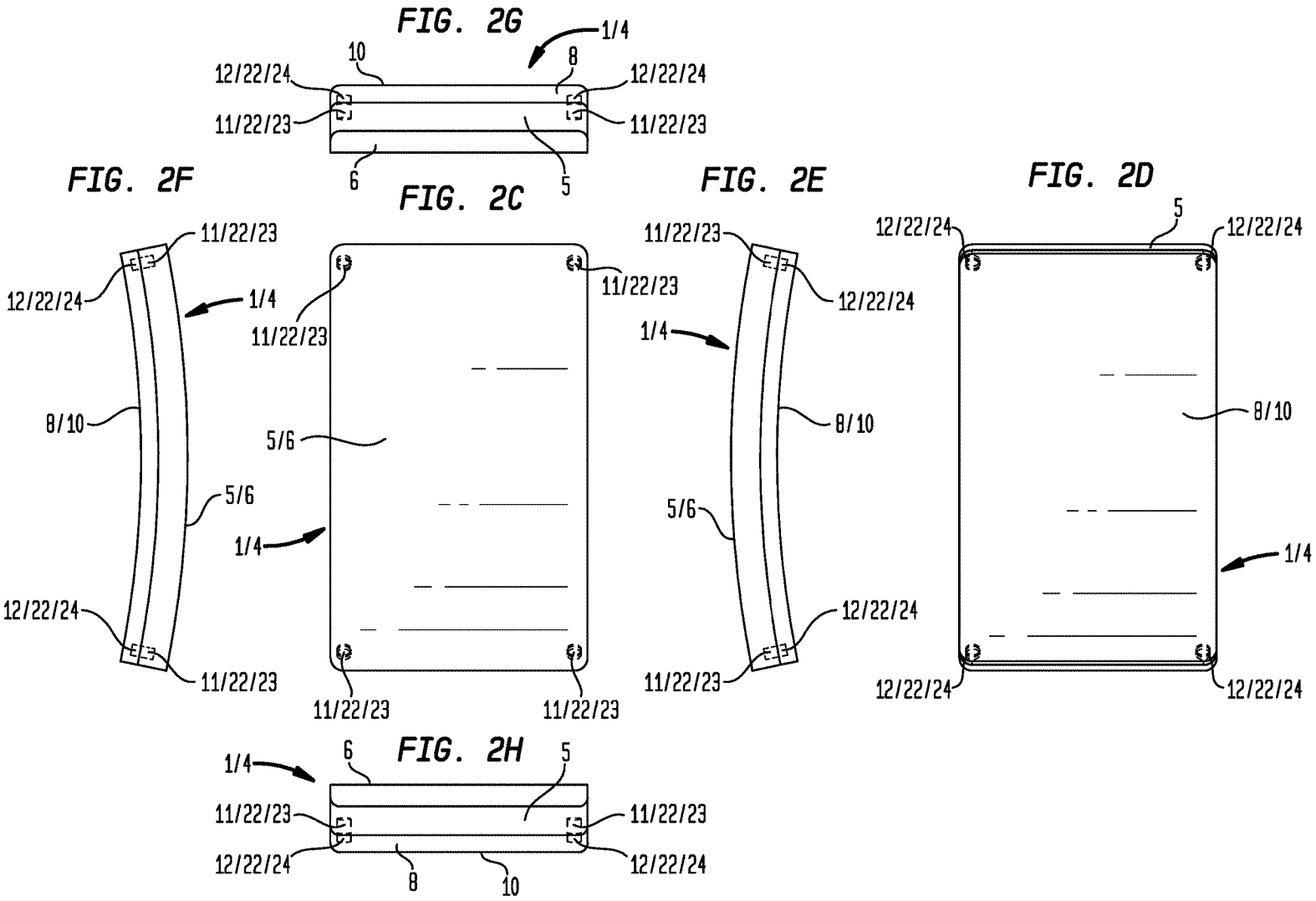
FIG. 2C is a front view of the particular embodiment of the inventive releasably engagable system of ballistic-resistant panels shown in FIG. 2B.
FIG. 2D is a rear view of the particular embodiment of the inventive releasably engagable system of ballistic-resistant panels shown in FIG. 2B.
FIG. 2E is a right side view of the particular embodiment of the inventive releasably engagable system of ballistic-resistant panels shown in FIG. 2B.
FIG. 2F is a left side view of the particular embodiment of the inventive releasably engagable system of ballistic-resistant panels shown in FIG. 2B.
FIG. 2G is a top view of the particular embodiment of the inventive releasably engagable system of ballistic-resistant panels shown in FIG. 2B.
FIG. 2H is a bottom view of the particular embodiment of the inventive releasably engagable system of ballistic-resistant panels shown in FIG. 2B.

The first and second fasteners (11)(12) can releasably engage to fasten the second ballistic-resistant panel front surface (9) to the first ballistic-resistant panel back surface (7) in fixed adjacent relation such that the second ballistic-resistant panel front surface (9) and the first ballistic-resistant panel back surface (7) are precluded from moving away from one another and particularly, are precluded from at least (i) axial movement (14) away from one another, (ii) lateral movement (15) in relation to one another, and (iii) vertical movement (16) in relation to one another (as shown in the example of FIG. 2B), whereby these movements (14)(15)(16) are precluded even after the releasably engaged ballistic-resistant panels (1) have been subjected to one or more ballistic threats.

Now referring primarily to FIG. 3A through FIG. 4H, as to particular embodiments, the fastener (11)(12) can be coupled to the ballistic-resistant panel (5)(8) proximate a ballistic-resistant panel surface (6)(7)(9)(10). As but one illustrative example, the first fastener (11) can be coupled to the first ballistic-resistant panel back surface (7) (as shown in the example of FIG. 3A through FIG. 3H) and the second fastener (12) can be coupled to the second ballistic-resistant panel front surface (9) (as shown in the example of FIG. 4A through FIG. 4H), whereby upon releasable engagement of the first and second fasteners (11)(12), the first ballistic-resistant panel back surface (7) can be fastened to the second ballistic-resistant panel front surface (9) in fixed adjacent relation.

Again referring primarily to FIG. 3A through FIG. 4H, as to particular embodiments, a plurality of fasteners (11)(12) can be coupled to the ballistic-resistant panel (5)(8) proximate a ballistic-resistant panel surface (6)(7)(9)(10).

As to particular embodiments, a plurality of fasteners (11)(12) can be coupled to the ballistic-resistant panel (5)(8) proximate the ballistic-resistant panel front surface (6)(9). Correspondingly, the ballistic-resistant panel front surface (6)(9) can be fastened to another ballistic-resistant panel (5)(8) with mating fasteners (11)(12) to provide a pair of releasably engaged ballistic-resistant panels (I). As but one illustrative example, a plurality of second fasteners (12) can be coupled to a second ballistic-resistant panel front surface (9).

As to other particular embodiments, a plurality of fasteners (11)(12) can be coupled to the ballistic-resistant panel (5)(8) proximate the ballistic-resistant panel back surface (7)(10). Correspondingly, the ballistic-resistant panel back surface (7)(10) can be fastened to another ballistic-resistant panel (5)(8) with mating fasteners (11)(12) to provide a pair of releasably engaged ballistic-resistant panels (1). As but one illustrative example, a plurality of first fasteners (11) can be coupled to a first ballistic-resistant panel back surface (7).

Figure 9B:
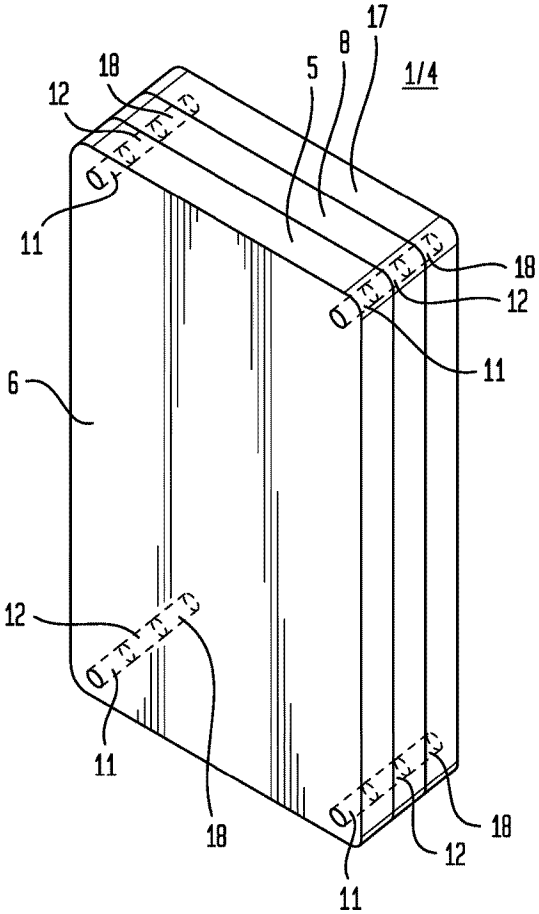
FIG. 9B is a perspective view of the plurality of ballistic-resistant panels shown in FIG. 9A, but whereby the plurality of ballistic-resistant panels are releasably engaged in fixed adjacent relation to provide releasably engaged ballistic-resistant panels.
Figure 9A:
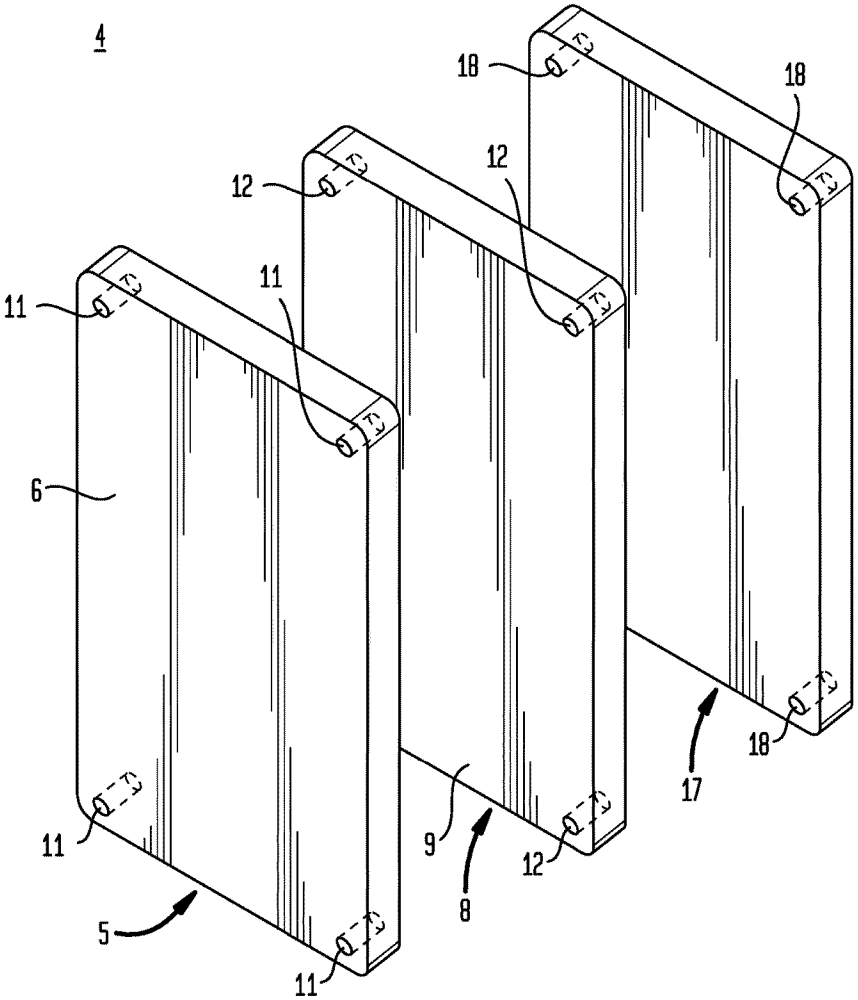
FIG. 9A is a perspective view of a particular embodiment of the inventive releasably engagable system of ballistic-resistant panels, whereby a plurality of ballistic-resistant panels are not releasably engaged in fixed adjacent relation.

Now referring primarily to FIG. 7A through FIG. 9B, as to still other particular embodiments, a plurality of fasteners (11)(12) can be coupled to the ballistic-resistant panel (5)(8) proximate both the ballistic-panel front surface (6)(9) and the ballistic-panel back surface (7)(10). Correspondingly, the ballistic-resistant panel front surface (6)(9) can be fastened to another ballistic-resistant panel (5)(8) with mating fasteners (11)(12), and the ballistic-resistant panel back surface (7)(10) can be fastened to an additional ballistic-resistant panel (17) with corresponding mating fasteners (18) to provide at least three releasably engaged ballistic-resistant panels (1) (as shown in the examples of FIG. 9A and FIG. 9B), whereby any number of ballistic-resistant panels can have fasteners coupled proximate both the ballistic-resistant panel front and back surfaces such that the process can be repeated any number of times to provide any number of releasably engaged ballistic-resistant panels (1), depending upon the application.

Again referring primarily to FIG. 3A through FIG. 4H, as to particular embodiments, a plurality of fasteners (11)(12) can be coupled to a ballistic-resistant panel surface (6)(7)(9)(10) in spaced apart relation proximate the perimeter (19) of the ballistic-resistant panel (5)(8). Thus, an inner portion (20) of the ballistic-resistant panel (5)(8) can be void of fasteners (11)(12), which may be advantageous if the fasteners (11)(12) lessen one or more ballistic-resistant properties of the portion of the ballistic-resistant panel (5)(8) to which the fasteners (5)(8) couple.

As but one illustrative example, a plurality of first fasteners (11) can be coupled to the first ballistic-resistant panel back surface (10) in spaced apart relation proximate the perimeter (19), whereby at least one first fastener (11) can be coupled proximate each of an upper right portion, an upper left portion, a lower right portion, and a lower left portion of the first ballistic-resistant panel back surface (10) (as shown in the example of FIG. 3A through FIG. 3H) and a plurality of second fasteners (12) can be coupled to the second ballistic-resistant panel front surface (9) in spaced apart relation proximate the perimeter (19), whereby at least one second fastener (12) can be coupled proximate each of an upper right portion, an upper left portion, a lower right portion, and a lower left portion of the second ballistic-resistant panel front surface (9) (as shown in the example of FIG. 4A through FIG. 4H).

The fastener (11)(12) can be any of a numerous and wide variety of fasteners, such as any of a numerous and wide variety of mechanical fasteners, depending upon the application, whereby upon releasable engagement of two fasteners (11)(12), the associated ballistic-resistant panels (5)(8) are fastened in fixed adjacent relation as described above.

Figure 10B:
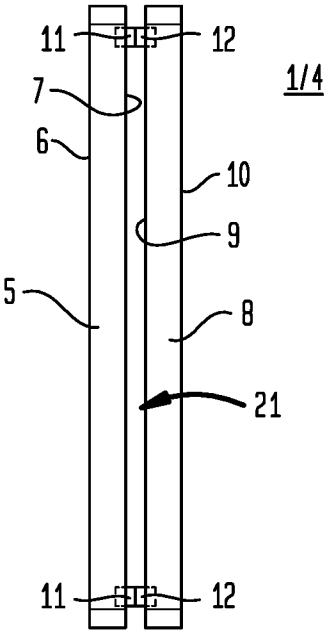
FIG. 10B is a side view of the first and second ballistic-resistant panels shown in FIG. 10A, but whereby the first and second ballistic-resistant panels are releasably engaged in fixed adjacent relation to provide releasably engaged ballistic-resistant panels.
Figure 10A:
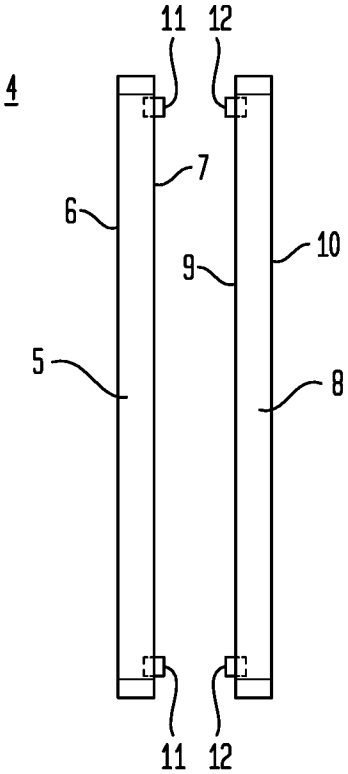
FIG. 10A is a side view of a particular embodiment of the inventive releasably engagable system of ballistic-resistant panels having first and second fasteners which each outwardly extend from a ballistic-resistant panel surface, whereby first and second ballistic-resistant panels are not releasably engaged in fixed adjacent relation.

Now referring primarily to FIG. 10A and FIG. 10B, as to particular embodiments, the fastener (11)(12) can be coupled to a ballistic-resistant panel surface (6)(7)(9)(10) such that at least a portion of the fastener (11)(12) outwardly extends from the ballistic-resistant panel surface (6)(7)(9)(10) and specifically, at least a portion of the fastener (11)(12) outwardly extends from the ballistic-resistant panel surface (6)(7)(9)(10) when first and second fasteners (11)(12) releasably engage to provide the releasably engaged ballistic-resistant panels (1). Accordingly, upon releasable engagement of the first and second fasteners (11)(12), the first ballistic-resistant panel back surface (7) and the second ballistic resistant panel front surface (9) can dispose in spaced apart fixed adjacent relation, thus creating a gap (21), such as an air gap (21), between the first ballistic-resistant panel back surface (7) and the second ballistic resistant panel front surface (9). As to particular embodiments, the air gap (21) created between the first ballistic-resistant panel back surface (7) and the second ballistic resistant panel front surface (9) may enhance the ballistic-resistance of the releasably engaged ballistic-resistant panels (1).

Figure 11B:
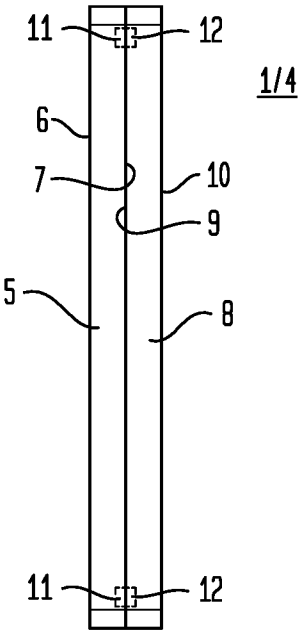
FIG. 11B is a side view of the first and second ballistic-resistant panels shown in FIG. 11A, but whereby the first and second ballistic-resistant panels are releasably engaged in fixed adjacent relation to provide releasably engaged ballistic-resistant panels.
Figure 11A:
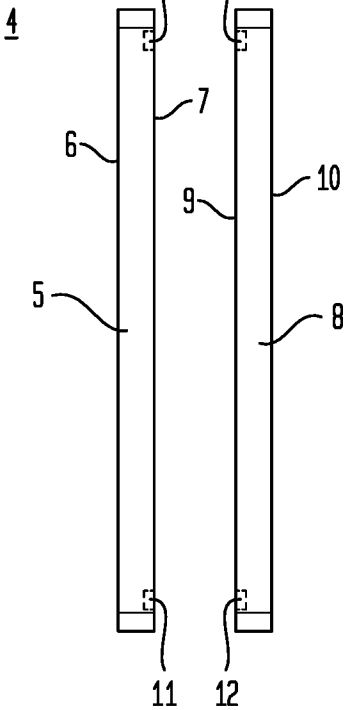
FIG. 11A is a side view of a particular embodiment of the inventive releasably engagable system of ballistic-resistant panels having first and second fasteners which each are inset with a ballistic-resistant panel, whereby first and second ballistic-resistant panels are not releasably engaged in fixed adjacent relation.

Now referring primarily to FIG. 11A and FIG. 11B, as to other particular embodiments, the fastener (11)(12) can be inset within (or inwardly extend into) the ballistic-resistant panel (5)(8) such that the fastener (11)(12) does not outwardly extend from the ballistic-resistant panel surface (6)(7)(9)(10). Thus, upon releasable engagement of the first and second fasteners (11)(12), the first ballistic-resistant panel back surface (7) and the second ballistic resistant panel front surface (9) can dispose in fixed adjacent relation, whereby the first ballistic-resistant panel back surface (7) and the second ballistic-resistant panel front surface (9) can be in contact with one another or nearly in contact with one another, which may enhance the ballistic-resistance of the releasably engaged ballistic-resistant panels (1).

Now referring primarily to FIG. 2A through FIG. 4H and FIG. 6A through FIG. 11B, as to particular embodiments, the fastener (11)(12) can, but need not necessarily, be a magnet (22). Accordingly, a first magnet (23) can be coupled to the first ballistic-resistant panel (5) and a second magnet (24) can be coupled to the second ballistic-resistant panel (8), whereby the second magnet (24) is configured to releasably magnetically engage with the first magnet (23) to fasten the second ballistic-resistant panel front surface (9) to the first ballistic-resistant panel back surface (7) in fixed adjacent relation or in spaced apart fixed adjacent relation to provide the releasably magnetically engaged ballistic-resistant panels (1).

The magnet (23)(24) can be any of a numerous and wide variety of magnets, whereby upon releasable magnetic engagement of two magnets (23)(24), the associated ballistic-resistant panels (5)(8) are fastened in fixed adjacent relation or in spaced apart fixed adjacent relation.

As but one illustrative example, the magnet (23)(24) can be a disc-type or cylinder-type magnet, as would be familiar to one of ordinary skill in the art. Thus, the magnet (23)(24) can have opposing magnet ends which are substantially planar, allowing for the magnet (23)(24) to be inset within the ballistic-resistant panel (5)(8) such that the magnet (23)(24) does not outwardly extend from the ballistic-resistant panel surface (6)(7)(9)(10). Thus, upon releasable magnetic engagement of first and second magnets (23)(24), the first and second ballistic-resistant panels (5)(8) can dispose in fixed adjacent relation, whereby the first ballistic-resistant panel back surface (7) and the second ballistic-resistant panel front surface (9) can be in contact with one another or nearly in contact with one another (as shown in the example of FIG. 11A and FIG. 11B), which may enhance the ballistic-resistance of the releasably magnetically engaged ballistic-resistant panels (1).

As to particular embodiments, the fastener (11)(12), such as the magnet (23)(24), can be configured to maintain its fastening properties during production of the ballistic-resistant panel (5)(8) from a stack of anti-ballistic sheets (13), as described above. Accordingly, the magnet (23)(24) can be disposed within the stack of anti-ballistic sheets (13), which can then be heated to an appropriate temperature (and, as to particular embodiments, exposed to an appropriate pressure) to promote partial or full bonding of adjacent anti-ballistic sheets (13) to provide the ballistic-resistant panel (5)(8), whereby following bonding, the magnet (23)(24) maintains its ability to releasably magnetically engage with another magnet (23)(24) to fasten ballistic-resistant panels (5)(8) in fixed adjacent relation or in spaced apart fixed adjacent relation to provide the releasably magnetically engaged ballistic-resistant panels (1).

As but one illustrative example, the magnet (23)(24) can be a neodymium (NdFeB) magnet with a maximum operating temperature of about 150° Celsius, as compared to other magnets having a maximum operating temperature of about 80° Celsius.

As to particular embodiments, the fastener (11)(12), such as the magnet (23)(24), can generate an audible indicium (25) upon releasable magnetic engagement to audibly alert a user that first and second ballistic-resistant panels (5)(8) have releasably magnetically engaged to provide the releasably magnetically engaged ballistic-resistant panels (1), which may afford greater protection against ballistic threats than the first ballistic-resistant panel (5) or the second ballistic-resistant panel (8) provides individually.

As to particular embodiments, the fastener (11)(12), such as the magnet (23)(24), can be directional to allow fastening in a first configuration having a desirable orientation of ballistic-resistant panels (5)(8) and precluding fastening in a second configuration having an undesirable orientation of ballistic-resistant panels (5)(8), which may be advantageous for relatively easily, quickly, and/or correctly releasably magnetically engaging ballistic-resistant panels (5)(8) in fixed adjacent relation to provide the releasably engaged ballistic-resistant panels (1).

Figure 12A:
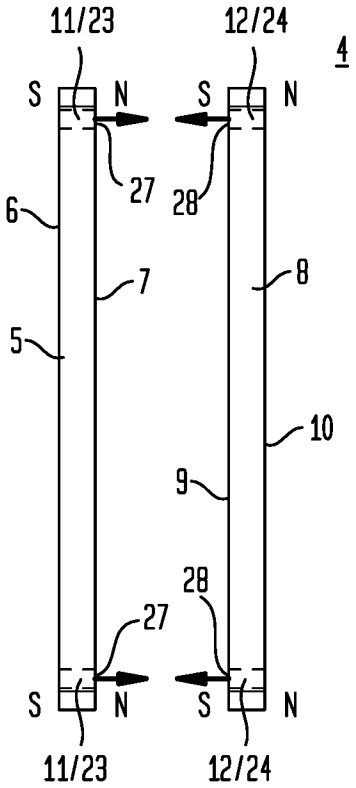
FIG. 12A is a side view of a particular embodiment of the inventive releasably engagable system of ballistic-resistant panels having first and second magnets which are directional to allow fastening in a first configuration and preclude fastening in a second configuration, whereby first and second ballistic-resistant panels are not releasably engaged in fixed adjacent relation.
Figure 12B:
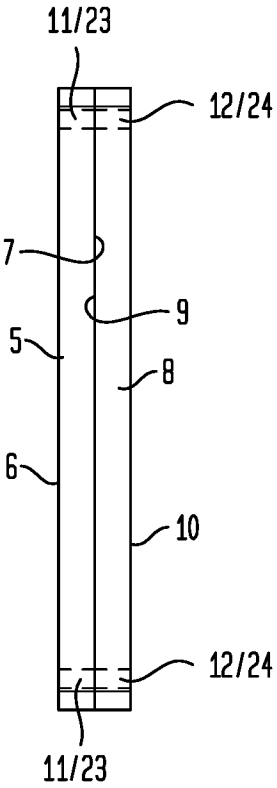
FIG. 12B is a side view of the first and second ballistic-resistant panels shown in FIG. 12A, whereby the first and second ballistic-resistant panels dispose in a first configuration and accordingly, can releasably engage in fixed adjacent relation to provide releasably engaged ballistic-resistant panels.

Now referring primarily to FIG. 12A and FIG. 12B, as but one illustrative example, if a desirable orientation of ballistic-resistant panels (5)(8) comprises a first configuration (26) whereby a second ballistic-resistant panel front surface (9) is fastened to a first ballistic-resistant panel back surface (7), a first magnet (23) can be coupled to the first ballistic-resistant panel (5) such that a first magnet north pole (27) disposes proximate the first ballistic-resistant panel back surface (7) and a second magnet (24) can be coupled to the second ballistic-resistant panel (8) such that a second magnet south pole (28) disposes proximate the second ballistic-resistant panel front surface (9). Correspondingly, the first magnet north pole (27) can releasably magnetically engage with the second magnet south pole (28) via attractive forces to provide the first configuration, whereby the second ballistic-resistant panel front surface (9) is fastened to the first ballistic-resistant panel back surface (7) in the desired orientation comprising the first configuration (26) to provide the releasably magnetically engaged ballistic-resistant panels (1).

Now referring primarily to FIG. 13, conversely, upon attempting to dispose the ballistic-resistant panels (5)(8) in an undesirable orientation comprising a second configuration (29) in which a second ballistic-resistant panel back surface (10) disposes proximate a first ballistic-resistant panel back surface (7), the first magnet north pole (27) can repel a second magnet north pole (30) which disposes proximate the second ballistic-resistant panel back surface (10) to preclude disposition of the first and second ballistic-resistant panels (5)(8) in the second configuration (29).

Now referring primarily to FIG. 14A and FIG. 14B, as to other particular embodiments, each fastener (11)(12) can, but need not necessarily, be a component of a hook and loop fastening system (31), such as VELCRO®. Accordingly, a first hook and loop fastening system component (32) comprising hook elements (33) can be coupled to the first ballistic-resistant panel (5) and a second hook and loop fastening system component (34) comprising loop elements (35) can be coupled to the second ballistic-resistant panel (8), whereby the hook elements (33) are configured to releasably hookingly engage with the loop elements (35) to fasten the second ballistic-resistant panel front surface (9) to the first ballistic-resistant panel back surface (7) in fixed adjacent relation or in spaced apart fixed adjacent relation to provide the releasably engaged ballistic-resistant panels (1).

Now referring primarily to FIG. 15A through FIG. 16B, as to other particular embodiments, each fastener (11)(12)

can, but need not necessarily, be a component of a post-and-socket fastening system (36).

Now referring primarily to FIG. 15A and FIG. 15B, as but one illustrative example, a first post-and-socket fastening system component (37), such as a post element (38), can be coupled to the first ballistic-resistant panel (5) and a second post-and-socket fastening system component (39), such as a socket element (40), can be inset within the second ballistic-resistant panel (8), whereby the socket element (40) can be configured to insertingly receive the post element (38) for releasable frictional engagement to fasten, for example via snapping, the second ballistic-resistant panel front surface (9) to the first ballistic-resistant panel back surface (7) in fixed adjacent relation or in spaced apart fixed adjacent relation to provide the releasably engaged ballistic-resistant panels (1).

Now referring primarily to FIG. 16A and FIG. 16B, as but a second illustrative example, a socket element (40) can be inset within each of the first and second ballistic resistant panels (5)(8), whereby each socket element (40) can be configured to insertingly receive an opposing end of a discrete post element (38) which is not coupled to either of the first or second ballistic resistant panels (5)(8) or is separate from the first and second ballistic resistant panels (5)(8). Accordingly, upon reception of each opposing end of the post element (38) within the socket elements (40) for releasable frictional engagement, the second ballistic-resistant panel front surface (9) can be fastened to the first ballistic-resistant panel back surface (7) in fixed adjacent relation or in spaced apart fixed adjacent relation to provide the releasably engaged ballistic-resistant panels (1).

Now referring primarily to FIG. 17A and FIG. 17B, another embodiment of the releasably engagable system of ballistic-resistant panels (4) can include an adhesive coating (41) coupled to at least one of the first ballistic-resistant panel back surface (7) or the second ballistic-resistant panel front surface (9), whereby the adhesive coating (41), which may function via mechanical forces and/or electrostatic forces, can be configured to releasably engage the second ballistic-resistant panel front surface (9) with the first ballistic-resistant panel back surface (7) in fixed adjacent relation or in spaced apart fixed adjacent relation to provide releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 18A through FIG. 19B, another embodiment of the releasably engagable system of ballistic-resistant panels (4) can include a securement element (42) discrete from the first and second ballistic-resistant panels (5)(8), whereby the securement element (42) can be configured to releasably secure the second ballistic-resistant panel front surface (9) to the first ballistic-resistant panel back surface (7) in fixed adjacent relation or in spaced apart fixed adjacent relation to provide releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 18A and FIG. 18B, as but one illustrative example, the securement element (42) can be configured as a channel (43), for example a C-channel (43), or a clamp (not shown), which can engage with at least one edge (44) of both the first and second ballistic-resistant panels (5)(8) to releasably secure the second ballistic-resistant panel front surface (9) to the first ballistic-resistant panel back surface (7) in fixed adjacent relation or in spaced apart fixed adjacent relation to provide the releasably engaged ballistic-resistant panels (1).

Now referring primarily to FIG. 19A and FIG. 19B, as but a second illustrative example, the securement element (42) can be configured as a resiliently stretchable member (45) which can entirely surround the first and second ballistic-resistant panels (5)(8) in at least one direction, for example horizontally (as shown in the example of FIG. 19B) or vertically (not shown), to releasably secure the second ballistic-resistant panel front surface (9) to the first ballistic-resistant panel back surface (7) in fixed adjacent relation or in spaced apart fixed adjacent relation to provide the releasably engaged ballistic-resistant panels (1).

As to particular embodiments, each of the ballistic-resistant panels (5)(8), as well as the releasably engagable system of ballistic-resistant panels (4), can be configured for coupling to a garment (2) to provide a ballistic-resistant garment (3) which may be worn to protect a wearer from ballistic threats, whereby the coupling can be proximate a garment outer surface, a garment inner surface, or combinations thereof, depending upon the application. For example, the garment (2) can, but need not necessarily, be akin to the ballistic-resistant garment detailed in U.S. 62/278,811, which is hereby incorporated by reference herein in its entirety.

Now referring primarily to FIG. 1 and FIG. 6A through FIG. 6F, as but one illustrative example, each of the ballistic-resistant panels (5)(8), as well as the releasably engagable system of ballistic-resistant panels (4), can be configured for disposition within a garment (2) to provide a ballistic-resistant garment (3) which may be worn to protect a wearer from ballistic threats.

Accordingly, a pocket (46) can be disposed within the garment (2), whereby the pocket (46) can be configured to receive the releasably engaged ballistic-resistant panels (1) to provide the ballistic-resistant garment (3).

Now referring primarily to FIG. 3A through FIG. 4G, and FIG. 6A through FIG. 8F, as to particular embodiments, the ballistic-resistant panel (5)(8) can, but need not necessarily, be contoured, which may be advantageous for disposition of the ballistic-resistant panel (5)(8) or the releasably engaged ballistic-resistant panels (1) within a garment (2) to provide the ballistic-resistant garment (3), whereby the contoured surface may enhance the fit of the ballistic-resistant panel (5)(8) or the releasably engaged ballistic-resistant panels (1) proximate the body of the wearer.

Now referring primarily to FIG. 3A through FIG. 4G, the ballistic-resistant panel (5)(8) can have a length (47) disposed between first and second ends (48)(49) and a width (50) disposed between first and second sides (51)(52), whereby the ballistic-resistant panel (5)(8) can be arcuate along the length (47). As but one illustrative example, the ballistic-resistant panel (5)(8) can have a length (47) of about 8 inches (about 20 centimeters), a width of about 5 inches (about 13 centimeters), and a lengthwise arc height (53) (sagitta) of about 0.4 inches (about 1 centimeter) (as shown in the examples of FIG. 3F and FIG. 4F); however, the configuration of the ballistic-resistant panel (5)(8) need not be limited to these dimensions.

Now referring primarily to FIG. 7A through FIG. 8G, the ballistic-resistant panel (5)(8) can be arcuate along the length (47) and the width (50). As but one illustrative example, the ballistic-resistant panel (5)(8) can have a length (47) of about 10 inches (about 25 centimeters), a width (50) of about 8 inches (about 20 centimeters), a lengthwise arc height (53) of about 0.5 inches (about 1.3 centimeters), and a widthwise arc height (54) of about 0.4 inches (about 1 centimeter); however, the configuration of the ballistic-resistant panel (5)(8) need not be limited to these dimensions.

Now referring primarily to FIG. 8A through FIG. 8G, as to particular embodiments, the ballistic-resistant panel (5)(8) can have an irregular perimeter shape which may not be relatively easily definable by simple geometric terms, whereby the irregular perimeter shape may be advantageous for disposition of the ballistic-resistant panel (5)(8) or the releasably engaged ballistic-resistant panels (1) within a garment (2) to provide the ballistic-resistant garment (3), possibly to enhance the fit of the ballistic-resistant panel (5)(8) or the releasably engaged ballistic-resistant panels (1) proximate the body of the wearer.

A method of making an embodiment of the releasably engagable system of ballistic-resistant panels (4) includes providing a first ballistic-resistant panel (5) having opposing first ballistic-resistant panel front and back surfaces (6)(7); providing a second ballistic-resistant panel (8) having opposing second ballistic-resistant panel front and back surfaces (9)(10); coupling a first fastener (11) to the first ballistic-resistant panel (5); and coupling a second fastener (12) to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1).

A method of making another embodiment of the releasably engagable system of ballistic-resistant panels (4) includes providing a first ballistic-resistant panel (5) having opposing first ballistic-resistant panel front and back surfaces (6)(7); providing a second ballistic-resistant panel (8) having opposing second ballistic-resistant panel front and back surfaces (9)(10); and coupling an adhesive coating (41) to at least one of the first ballistic-resistant panel back surface (7) or the second ballistic-resistant panel front surface (9), whereby the adhesive coating (41) functions to releasably engage the second ballistic-resistant panel front surface (9) with the first ballistic-resistant panel back surface (7) in fixed adjacent relation to provide releasably engaged ballistic-resistant panels (1).

A method of making another embodiment of the releasably engagable system of ballistic-resistant panels (4) includes providing a first ballistic-resistant panel (5) having opposing first ballistic-resistant panel front and back surfaces (6)(7); providing a second ballistic-resistant panel (8) having opposing second ballistic-resistant panel front and back surfaces (9)(10); and providing a securement element (42) discrete from the first and second ballistic-resistant panels (5)(8), whereby the securement element (42) is configured to releasably secure the second ballistic-resistant panel front surface (9) to the first ballistic-resistant panel back surface (7) in fixed adjacent relation to provide releasably engaged ballistic-resistant panels (1).

The method of making the various embodiments of the releasably engagable system of ballistic-resistant panels (4) can further include providing additional components as described above and in the claims.

A method of making an embodiment of the ballistic-resistant garment (3) includes providing a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), a first fastener (11) coupled to the first ballistic-resistant panel (5), and a second fastener (12) coupled to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1); and providing a garment (2) having a pocket (46) disposed therein, whereby the pocket (46) is configured to receive the releasably engaged ballistic-resistant panels (1) to provide the ballistic-resistant garment (3).

A method of making another embodiment of the ballistic-resistant garment (3) includes providing a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and an adhesive coating (41) coupled to at least one of the first ballistic-resistant panel back surface (7) or the second ballistic-resistant panel front surface (9), whereby the adhesive coating (41) functions to releasably engage the second ballistic-resistant panel front surface (9) with the first ballistic-resistant panel back surface (7) in fixed adjacent relation to provide releasably engaged ballistic-resistant panels (1); and providing a garment (2) having a pocket (46) disposed therein, whereby the pocket (46) is configured to receive the releasably engaged ballistic-resistant panels (1) to provide the ballistic-resistant garment (3).

A method of making another embodiment of the ballistic-resistant garment (3) includes providing a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and a securement element (42) discrete from the first and second ballistic-resistant panels (5)(8), whereby the securement element (42) is configured to releasably secure the second ballistic-resistant panel front surface (9) to the first ballistic-resistant panel back surface (7) in fixed adjacent relation to provide releasably engaged ballistic-resistant panels (1); and providing a garment (2) having a pocket (46) disposed therein, whereby the pocket (46) is configured to receive the releasably engaged ballistic-resistant panels (1) to provide the ballistic-resistant garment (3).

The method of making the various embodiments of the ballistic-resistant garment (3) can further include providing additional components as described above and in the claims.

A method of using an embodiment of the releasably engagable system of ballistic-resistant panels (4) includes obtaining the releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), a first fastener (11) coupled to the first ballistic-resistant panel (5), and a second fastener (12) coupled to the second ballistic-resistant panel (8); and releasably engaging the second fastener (12) with the first fastener (11) to fasten the second ballistic-resistant panel front surface (9) to the first ballistic-resistant panel back surface (7) in fixed adjacent relation to provide the releasably engaged ballistic-resistant panels (1).

A method of using another embodiment of the releasably engagable system of ballistic-resistant panels (4) includes obtaining the releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and an adhesive coating (41) coupled to at least one of the first ballistic-resistant panel back surface (7) or the second ballistic-resistant panel front surface (9); and releasably adhering the first and second ballistic-resistant panels (5)(8) together via the adhesive coating (41) to fasten the second ballistic-resistant panel front surface (9) to the first ballistic-resistant panel back surface (7) in fixed adjacent relation to provide the releasably engaged ballistic-resistant panels (1).

A method of using another embodiment of the releasably engagable system of ballistic-resistant panels (4) includes obtaining the releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and a securement element (42) discrete from the first and second ballistic-resistant panels (5)(8); and releasably securing the first and second ballistic-resistant panels (5)(8) together via the securement element (42) to fasten the second ballistic-resistant panel front surface (9) to the first ballistic-resistant panel back surface (7) in fixed adjacent relation to provide the releasably engaged ballistic-resistant panels (1).

The method of using the various embodiments of the releasably engagable system of ballistic-resistant panels (4) can further include additional actions as described above and in the claims.

A method of using an embodiment of the ballistic-resistant garment (3) includes obtaining a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), a first fastener (11) coupled to the first ballistic-resistant panel (5), and a second fastener (12) coupled to the second ballistic-resistant panel (8); obtaining a garment (2) having a pocket (46) disposed therein; releasably engaging the second fastener (12) with the first fastener (11) to fasten the second ballistic-resistant panel front surface (9) to the first ballistic-resistant panel back surface (7) in fixed adjacent relation to provide the releasably engaged ballistic-resistant panels (1); and disposing the releasably engaged ballistic-resistant panels (1) within the pocket (46) to provide the ballistic-resistant garment (3).

A method of using another embodiment of the ballistic-resistant garment (3) includes obtaining a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and an adhesive coating (41) coupled to at least one of the first ballistic-resistant panel back surface (7) or the second ballistic-resistant panel front surface (9); obtaining a garment (2) having a pocket (46) disposed therein; releasably adhering the first and second ballistic-resistant panels (5)(8) together via the adhesive coating (41) to fasten the second ballistic-resistant panel front surface (9) to the first ballistic-resistant panel back surface (7) in fixed adjacent relation to provide the releasably engaged ballistic-resistant panels (1); and disposing the releasably engaged ballistic-resistant panels (1) within the pocket (46) to provide the ballistic-resistant garment (3).

A method of using another embodiment of the ballistic-resistant garment (3) includes obtaining a releasably engagable system of ballistic-resistant panels (4) comprising: a first ballistic-resistant panel (5) having opposing first ballistic-resistant panel front and back surfaces (6)(7), a second ballistic-resistant panel (8) having opposing second ballistic-resistant panel front and back surfaces (9)(10), and a securement element (42) discrete from the first and second ballistic-resistant panels (5)(8); obtaining a garment (2) having a pocket (46) disposed therein; releasably securing the first and second ballistic-resistant panels (5)(8) together via the securement element (42) to fasten the second ballistic-resistant panel front surface (9) to the first ballistic-resistant panel back surface (7) in fixed adjacent relation to provide the releasably engaged ballistic-resistant panels (1); and disposing the releasably engaged ballistic-resistant panels (1) within the pocket (46) to provide the ballistic-resistant garment (3).

The method of using the various embodiments of the ballistic-resistant garment (3) can further include additional actions as described above and in the claims.

As can be easily understood from the foregoing, the basic concepts of the present invention may be embodied in a variety of ways. The invention involves numerous and varied embodiments of a releasably engagable system of ballistic-resistant panels and methods for making and using such a releasably engagable system of ballistic-resistant panels, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value foul's another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a wearer (2) of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant(s) should be understood to claim at least: i) each of the releasably engagable systems of ballistic-resistant panels herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A releasably engagable system of ballistic-resistant panels comprising: a first ballistic-resistant panel formed from a plurality of anti-ballistic sheets, said first ballistic-resistant panel having opposing first ballistic-resistant panel front and back surfaces; a second ballistic-resistant panel formed from a plurality of anti-ballistic sheets, said second ballistic-resistant panel having opposing second ballistic-resistant panel front and back surfaces; a plurality of first fasteners coupled to said first ballistic-resistant panel; and a plurality of second fasteners inset within said second ballistic-resistant panel to inwardly extend into said second ballistic-resistant panel front surface; said second fasteners configured to releasably engage with said first fasteners to fasten said second ballistic-resistant panel front surface to said first ballistic-resistant panel back surface in fixed adjacent relation to provide releasably engaged ballistic-resistant panels; and said first and second fasteners comprise corresponding first and second magnets; wherein said first and second ballistic-resistant panels are formed from a material selected from the group consisting of: fiberglass, aramid fibers, para-aramid fibers, meta-aramid fibers, polyolefins, and thermoplastic polyethylenes.

2. The releasably engagable system of ballistic-resistant panels of claim 1, wherein said first fasteners are coupled to said first ballistic-resistant panel back surface in spaced apart relation proximate a first ballistic-resistant panel perimeter, and said second fasteners are coupled to said second ballistic-resistant panel front surface in spaced apart relation proximate a second ballistic-resistant panel perimeter.

3. The releasably engagable system of ballistic-resistant panels of claim 1, wherein said first and second fasteners are inset within corresponding said first and second ballistic-resistant panels.

4. The releasably engagable system of ballistic-resistant panels of claim 1, wherein said first and second magnets generate an audible indicium upon releasable magnetic engagement to audibly alert a user that said first and second ballistic-resistant panels are releasably magnetically engaged to provide said releasably magnetically engaged ballistic-resistant panels.

5. The releasably engagable system of ballistic-resistant panels of claim 1, wherein a first ballistic-resistant panel inner portion and a second ballistic-resistant panel inner portion are void of corresponding said first and second fasteners.

6. A releasably engagable system of ballistic-resistant panels comprising: a first ballistic-resistant panel formed from a plurality of anti-ballistic sheets, said first ballistic-resistant panel having opposing first ballistic-resistant panel front and back surfaces; a second ballistic-resistant panel formed from a plurality of anti-ballistic sheets, said second ballistic-resistant panel having opposing second ballistic-resistant panel front and back surfaces; a plurality of first fasteners inset within said first ballistic-resistant panel to inwardly extend into said first ballistic-resistant panel back surface; and a plurality of second fasteners coupled to said second ballistic-resistant panel; said second fasteners configured to releasably engage with said first fasteners to fasten said second ballistic-resistant panel front surface to said first ballistic-resistant panel back surface in fixed adjacent relation to provide releasably engaged ballistic-resistant panels; and said first and second fasteners comprise corresponding first and second magnets; wherein said first and second ballistic-resistant panels are formed from a material selected from the group consisting of: fiberglass, aramid fibers, para-aramid fibers, meta-aramid fibers, polyolefins, and thermoplastic polyethylenes.

7. The releasably engagable system of ballistic-resistant panels of claim 6, wherein said first fasteners are coupled to said first ballistic-resistant panel back surface in spaced apart relation proximate a first ballistic-resistant panel perimeter, and said second fasteners are coupled to said second ballistic-resistant panel front surface in spaced apart relation proximate a second ballistic-resistant panel perimeter.

8. The releasably engagable system of ballistic-resistant panels of claim 6, wherein said first and second fasteners are inset within corresponding said first and second ballistic-resistant panels.

9. The releasably engagable system of ballistic-resistant panels of claim 6, wherein said first and second magnets generate an audible indicium upon releasable magnetic engagement to audibly alert a user that said first and second ballistic-resistant panels are releasably magnetically engaged to provide said releasably magnetically engaged ballistic-resistant panels.

10. The releasably engagable system of ballistic-resistant panels of claim 6, wherein a first ballistic-resistant panel inner portion and a second ballistic-resistant panel inner portion are void of corresponding said first and second fasteners.

* * * * *